US009741292B2

(12) United States Patent
Nathan et al.

(10) Patent No.: US 9,741,292 B2
(45) **Date of Patent: *Aug. 22, 2017**

(54) METHOD AND SYSTEM FOR PROGRAMMING AND DRIVING ACTIVE MATRIX LIGHT EMITTING DEVICE PIXEL HAVING A CONTROLLABLE SUPPLY VOLTAGE

(71) Applicant: Ignis Innovation Inc., Waterloo (CA)

(72) Inventors: Arokia Nathan, Cambridge (GB); Gholamreza Chaji, Waterloo (CA); Peyman Servati, Vancouver (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/843,211

(22) Filed: Sep. 2, 2015

(65) Prior Publication Data

US 2015/0379932 A1 Dec. 31, 2015

Related U.S. Application Data

(63) Continuation of application No. 13/744,843, filed on Jan. 18, 2013, now Pat. No. 9,153,172, which is a (Continued)

(30) Foreign Application Priority Data

Dec. 7, 2004 (CA) ..... 2490858

(51) Int. Cl.
*G09G 3/32* (2016.01)
*G09G 3/3258* (2016.01)
(Continued)

(52) U.S. Cl.
CPC ..... *G09G 3/3258* (2013.01); *G09G 3/3233* (2013.01); *G09G 3/3696* (2013.01);
(Continued)

(58) Field of Classification Search
CPC ..... G09G 3/3258
(Continued)

(56) References Cited

U.S. PATENT DOCUMENTS 3,506,851 A 4/1970 Polkinghorn et al.
3,750,987 A 8/1973 Gobel
(Continued)

FOREIGN PATENT DOCUMENTS

AU 729652 6/1997
AU 764896 12/2001
(Continued)

OTHER PUBLICATIONS

Ahnood et al.: "Effect of threshold voltage instability on field effect mobility in thin film transistors deduced from constant current measurements"; dated Aug. 2009.
(Continued)

*Primary Examiner* — Long D Pham
(74) *Attorney, Agent, or Firm* — Nixon Peabody LLP

(57) ABSTRACT

Method and system for programming and driving active matrix light emitting device pixel is provided. The pixel is a voltage programmed pixel circuit, and has a light emitting device, a driving transistor and a storage capacitor. The pixel has a programming cycle having a plurality of operating cycles, and a driving cycle. During the programming cycle, the voltage of the connection between the OLED and the driving transistor is controlled so that the desired gate-source voltage of a driving transistor is stored in a storage capacitor.

15 Claims, 22 Drawing Sheets

Related U.S. Application Data continuation of application No. 13/243,065, filed on Sep. 23, 2011, now Pat. No. 8,378,938, which is a continuation of application No. 12/851,652, filed on Aug. 6, 2010, now Pat. No. 8,405,587, which is a continuation of application No. 11/298,240, filed on Dec. 7, 2005, now Pat. No. 7,800,565.

(51) Int. Cl.
*G09G 3/36* (2006.01)
*G09G 3/3233* (2016.01)

(52) U.S. Cl.
CPC ..... *G09G 2300/0465* (2013.01); *G09G 2300/0842* (2013.01); *G09G 2300/0852* (2013.01); *G09G 2310/0262* (2013.01); *G09G 2310/06* (2013.01); *G09G 2310/061* (2013.01); *G09G 2320/043* (2013.01)

(58) Field of Classification Search
USPC ..... 345/82
See application file for complete search history.

(56) References Cited

U.S. PATENT DOCUMENTS 3,774,055 A 11/1973 Bapat et al.
4,090,096 A 5/1978 Nagami
4,354,162 A 10/1982 Wright
4,996,523 A 2/1991 Bell et al.
5,134,387 A 7/1992 Smith et al.
5,153,420 A 10/1992 Hack et al.
5,170,158 A 12/1992 Shinya
5,204,661 A 4/1993 Hack et al.
5,266,515 A 11/1993 Robb et al.
5,278,542 A 1/1994 Smith et al.
5,408,267 A 4/1995 Main
5,498,880 A 3/1996 Lee et al.
5,572,444 A 11/1996 Lentz et al.
5,589,847 A 12/1996 Lewis
5,619,033 A 4/1997 Weisfield
5,648,276 A 7/1997 Hara et al.
5,670,973 A 9/1997 Bassetti et al.
5,691,783 A 11/1997 Numao et al.
5,701,505 A 12/1997 Yamashita et al.
5,714,968 A 2/1998 Ikeda
5,744,824 A 4/1998 Kousai et al.
5,745,660 A 4/1998 Kolpatzik et al.
5,748,160 A 5/1998 Shieh et al.
5,758,129 A 5/1998 Gray et al.
5,835,376 A 11/1998 Smith et al.
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,949,398 A 9/1999 Kim
5,952,789 A 9/1999 Stewart et al.
5,990,629 A 11/1999 Yamada et al.
6,023,259 A 2/2000 Howard et al.
6,069,365 A 5/2000 Chow et al.
6,091,203 A 7/2000 Kawashima et al.
6,097,360 A 8/2000 Holloman
6,100,868 A 8/2000 Lee et al.
6,144,222 A 11/2000 Ho
6,229,506 B1 5/2001 Dawson et al.
6,229,508 B1 5/2001 Kane
6,246,180 B1 6/2001 Nishigaki
6,252,248 B1 6/2001 Sano et al.
6,268,841 B1 7/2001 Cairns et al.
6,288,696 B1 9/2001 Holloman
6,307,322 B1 10/2001 Dawson et al.
6,310,962 B1 10/2001 Chung et al.
6,323,631 B1 11/2001 Juang
6,333,729 B1 12/2001 Ha
6,384,804 B1 5/2002 Dodabalapur et al.
6,388,653 B1 5/2002 Goto et al.
6,392,617 B1 5/2002 Gleason
6,396,469 B1 5/2002 Miwa et al.
6,414,661 B1 7/2002 Shen et al.
6,417,825 B1 7/2002 Stewart et al.
6,430,496 B1 8/2002 Smith et al.
6,433,488 B1 8/2002 Bu
6,473,065 B1 10/2002 Fan
6,475,845 B2 11/2002 Kimura
6,501,098 B2 12/2002 Yamazaki
6,501,466 B1 12/2002 Yamagishi et al.
6,522,315 B2 2/2003 Ozawa et al.
6,535,185 B2 3/2003 Kim et al.
6,542,138 B1 4/2003 Shannon et al.
6,559,839 B1 5/2003 Ueno et al.
6,580,408 B1 6/2003 Bae et al.
6,583,398 B2 6/2003 Harkin
6,618,030 B2 9/2003 Kane et al.
6,639,244 B1 10/2003 Yamazaki et al.
6,680,580 B1 1/2004 Sung
6,686,699 B2 2/2004 Yumoto
6,690,000 B1 2/2004 Muramatsu et al.
6,693,610 B2 2/2004 Shannon et al.
6,694,248 B2 2/2004 Smith et al.
6,697,057 B2 2/2004 Koyama et al.
6,724,151 B2 4/2004 Yoo
6,734,636 B2 5/2004 Sanford et al.
6,753,655 B2 6/2004 Shih et al.
6,753,834 B2 6/2004 Mikami et al.
6,756,741 B2 6/2004 Li
6,777,888 B2 8/2004 Kondo
6,781,567 B2 8/2004 Kimura
6,788,231 B1 9/2004 Hsueh
6,809,706 B2 10/2004 Shimoda
6,828,950 B2 12/2004 Koyama
6,858,991 B2 2/2005 Miyazawa
6,859,193 B1 2/2005 Yumoto
6,876,346 B2 4/2005 Anzai et al.
6,900,485 B2 5/2005 Lee
6,903,734 B2 6/2005 Eu
6,911,960 B1 6/2005 Yokoyama
6,911,964 B2 6/2005 Lee et al.
6,914,448 B2 7/2005 Jinno
6,919,871 B2 7/2005 Kwon
6,924,602 B2 8/2005 Komiya
6,937,220 B2 8/2005 Kitaura et al.
6,940,214 B1 9/2005 Komiya et al.
6,954,194 B2 10/2005 Matsumoto et al.
6,970,149 B2 11/2005 Chung et al.
6,975,142 B2 12/2005 Azami et al.
6,975,332 B2 12/2005 Arnold et al.
6,995,519 B2 2/2006 Arnold et al.
7,027,015 B2 4/2006 Booth, Jr. et al.
7,034,793 B2 4/2006 Sekiya et al.
7,038,392 B2 5/2006 Libsch et al.
7,057,588 B2 6/2006 Asano et al.
7,061,451 B2 6/2006 Kimura
7,071,932 B2 7/2006 Libsch et al.
7,106,285 B2 9/2006 Naugler
7,112,820 B2 9/2006 Chang et al.
7,113,864 B2 9/2006 Smith et al.
7,122,835 B1 10/2006 Ikeda et al.
7,129,914 B2 10/2006 Knapp et al.
7,164,417 B2 1/2007 Cok
7,224,332 B2 5/2007 Cok
7,248,236 B2 7/2007 Nathan et al.
7,259,737 B2 8/2007 Ono et al.
7,262,753 B2 8/2007 Tanghe et al.
7,274,363 B2 9/2007 Ishizuka et al.
7,310,092 B2 12/2007 Imamura
7,315,295 B2 1/2008 Kimura
7,317,434 B2 1/2008 Lan et al.
7,321,348 B2 1/2008 Cok et al.
7,327,357 B2 2/2008 Jeong
7,333,077 B2 2/2008 Koyama et al.
7,343,243 B2 3/2008 Smith et al.
7,414,600 B2 8/2008 Nathan et al.
7,466,166 B2 12/2008 Date et al.

(56) References Cited

U.S. PATENT DOCUMENTS 7,495,501 B2 2/2009 Iwabuchi et al.
7,502,000 B2 3/2009 Yuki et al.
7,515,124 B2 4/2009 Yaguma et al.
7,535,449 B2 5/2009 Miyazawa
7,554,512 B2 6/2009 Steer
7,569,849 B2 8/2009 Nathan et al.
7,595,776 B2 9/2009 Hashimoto et al.
7,604,718 B2 10/2009 Zhang et al.
7,609,239 B2 10/2009 Chang
7,612,745 B2 11/2009 Yumoto et al.
7,619,594 B2 11/2009 Hu
7,619,597 B2 11/2009 Nathan et al.
7,639,211 B2 12/2009 Miyazawa
7,683,899 B2 3/2010 Hirakata et al.
7,688,289 B2 3/2010 Abe et al.
7,760,162 B2 7/2010 Miyazawa
7,808,008 B2 10/2010 Miyake
7,859,520 B2 12/2010 Kimura
7,889,159 B2 2/2011 Nathan et al.
7,903,127 B2 3/2011 Kwon
7,920,116 B2 4/2011 Woo et al.
7,944,414 B2 5/2011 Shirasaki et al.
7,978,170 B2 7/2011 Park et al.
7,989,392 B2 8/2011 Crockett et al.
7,995,008 B2 8/2011 Miwa
8,063,852 B2 11/2011 Kwak et al.
8,102,343 B2 1/2012 Yatabe
8,144,081 B2 3/2012 Miyazawa
8,159,007 B2 4/2012 Bama et al.
8,242,979 B2 8/2012 Anzai et al.
8,253,665 B2 8/2012 Nathan et al.
8,283,967 B2 10/2012 Chaji et al.
8,319,712 B2 11/2012 Nathan et al.
8,564,513 B2 10/2013 Nathan et al.
8,872,739 B2 10/2014 Kimura
2001/0002703 A1 6/2001 Koyama
2001/0009283 A1 7/2001 Arao et al.
2001/0024186 A1 9/2001 Kane et al.
2001/0026257 A1 10/2001 Kimura
2001/0030323 A1 10/2001 Ikeda
2001/0035863 A1 11/2001 Kimura
2001/0040541 A1 11/2001 Yoneda et al.
2001/0043173 A1 11/2001 Troutman
2001/0045929 A1 11/2001 Prache
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0030190 A1 3/2002 Ohtani et al.
2002/0030647 A1 3/2002 Hack et al.
2002/0047565 A1 4/2002 Nara et al.
2002/0052086 A1 5/2002 Maeda
2002/0080108 A1 6/2002 Wang
2002/0084463 A1 7/2002 Sanford et al.
2002/0101172 A1 8/2002 Bu
2002/0117722 A1 8/2002 Osada et al.
2002/0140712 A1 10/2002 Ouchi et al.
2002/0158587 A1 10/2002 Komiya
2002/0158666 A1 10/2002 Azami et al.
2002/0158823 A1 10/2002 Zavracky et al.
2002/0171613 A1 11/2002 Goto et al.
2002/0181276 A1 12/2002 Yamazaki
2002/0186214 A1 12/2002 Siwinski
2002/0190971 A1 12/2002 Nakamura et al.
2002/0195967 A1 12/2002 Kim et al.
2002/0195968 A1 12/2002 Sanford et al.
2003/0001828 A1 1/2003 Asano
2003/0001858 A1 1/2003 Jack
2003/0016190 A1 1/2003 Kondo
2003/0020413 A1 1/2003 Oomura
2003/0030603 A1 2/2003 Shimoda
2003/0062524 A1 4/2003 Kimura
2003/0062844 A1 4/2003 Miyazawa
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0117348 A1 6/2003 Knapp et al.
2003/0122474 A1 7/2003 Lee
2003/0122747 A1 7/2003 Shannon et al.
2003/0128199 A1 7/2003 Kimura
2003/0151569 A1 8/2003 Lee et al.
2003/0156104 A1 8/2003 Morita
2003/0169241 A1 9/2003 LeChevalier
2003/0169247 A1 9/2003 Kawabe et al.
2003/0174152 A1 9/2003 Noguchi
2003/0179626 A1 9/2003 Sanford et al.
2003/0185438 A1 10/2003 Osawa et al.
2003/0189535 A1 10/2003 Matsumoto et al.
2003/0197663 A1 10/2003 Lee et al.
2003/0214465 A1 11/2003 Kimura
2003/0227262 A1 12/2003 Kwon
2003/0230141 A1 12/2003 Gilmour et al.
2003/0230980 A1 12/2003 Forrest et al.
2004/0004589 A1 1/2004 Shih
2004/0032382 A1 2/2004 Cok et al.
2004/0041750 A1 3/2004 Abe
2004/0066357 A1 4/2004 Kawasaki
2004/0070557 A1 4/2004 Asano et al.
2004/0070558 A1 4/2004 Cok
2004/0090186 A1 5/2004 Yoshida et al.
2004/0129933 A1 7/2004 Nathan et al.
2004/0130516 A1 7/2004 Nathan et al.
2004/0135749 A1 7/2004 Kondakov et al.
2004/0145547 A1 7/2004 Oh
2004/0150595 A1 8/2004 Kasai
2004/0155841 A1 8/2004 Kasai
2004/0174349 A1 9/2004 Libsch
2004/0174354 A1 9/2004 Ono
2004/0183759 A1 9/2004 Stevenson et al.
2004/0189627 A1 9/2004 Shirasaki et al.
2004/0196275 A1 10/2004 Hattori
2004/0227697 A1 11/2004 Mori
2004/0239696 A1 12/2004 Okabe
2004/0251844 A1 12/2004 Hashido et al.
2004/0252085 A1 12/2004 Miyagawa
2004/0252089 A1 12/2004 Ono et al.
2004/0256617 A1 12/2004 Yamada et al.
2004/0257353 A1 12/2004 Imamura et al.
2004/0257355 A1 12/2004 Naugler
2004/0263437 A1 12/2004 Hattori
2005/0007357 A1 1/2005 Yamashita et al.
2005/0052379 A1 3/2005 Waterman
2005/0057459 A1 3/2005 Miyazawa
2005/0067970 A1 3/2005 Libsch et al.
2005/0067971 A1 3/2005 Kane
2005/0083270 A1 4/2005 Miyazawa
2005/0088103 A1 4/2005 Kageyama et al.
2005/0110420 A1 5/2005 Arnold et al.
2005/0110727 A1 5/2005 Shin
2005/0123193 A1 6/2005 Lamberg et al.
2005/0140600 A1 6/2005 Kim et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0206590 A1 9/2005 Sasaki et al.
2005/0212787 A1 9/2005 Noguchi et al.
2005/0219188 A1 10/2005 Kawabe et al.
2005/0243037 A1 11/2005 Eom et al.
2005/0248515 A1 11/2005 Naugler et al.
2005/0258867 A1 11/2005 Miyazawa
2005/0285822 A1 12/2005 Reddy et al.
2005/0285825 A1 12/2005 Eom et al.
2006/0012310 A1 1/2006 Chen et al.
2006/0012311 A1 1/2006 Ogawa

(56) References Cited

U.S. PATENT DOCUMENTS

| | | | |
|---|---|---|---|
| 2006/0022305 | A1 | 2/2006 | Yamashita |
| 2006/0038750 | A1 | 2/2006 | Inoue et al. |
| 2006/0038758 | A1 | 2/2006 | Routley et al. |
| 2006/0038762 | A1 | 2/2006 | Chou |
| 2006/0066533 | A1 | 3/2006 | Sato et al. |
| 2006/0077077 | A1 | 4/2006 | Kwon |
| 2006/0077194 | A1 | 4/2006 | Jeong |
| 2006/0092185 | A1 | 5/2006 | Jo et al. |
| 2006/0125408 | A1 | 6/2006 | Nathan et al. |
| 2006/0125740 | A1 | 6/2006 | Shirasaki et al. |
| 2006/0139253 | A1 | 6/2006 | Choi et al. |
| 2006/0145964 | A1 | 7/2006 | Park et al. |
| 2006/0158402 | A1 | 7/2006 | Nathan |
| 2006/0191178 | A1 | 8/2006 | Sempel et al. |
| 2006/0208971 | A1 | 9/2006 | Deane |
| 2006/0209012 | A1 | 9/2006 | Hagood, IV |
| 2006/0214888 | A1 | 9/2006 | Schneider et al. |
| 2006/0221009 | A1 | 10/2006 | Miwa |
| 2006/0227082 | A1 | 10/2006 | Ogata et al. |
| 2006/0232522 | A1 | 10/2006 | Roy et al. |
| 2006/0244391 | A1 | 11/2006 | Shishido et al. |
| 2006/0244697 | A1 | 11/2006 | Lee et al. |
| 2006/0261841 | A1 | 11/2006 | Fish |
| 2006/0290614 | A1 | 12/2006 | Nathan et al. |
| 2007/0001939 | A1 | 1/2007 | Hashimoto et al. |
| 2007/0001945 | A1 | 1/2007 | Yoshida et al. |
| 2007/0008251 | A1 | 1/2007 | Kohno et al. |
| 2007/0008297 | A1 | 1/2007 | Bassetti |
| 2007/0035489 | A1 | 2/2007 | Lee |
| 2007/0035707 | A1 | 2/2007 | Margulis |
| 2007/0040773 | A1 | 2/2007 | Lee et al. |
| 2007/0040782 | A1 | 2/2007 | Woo et al. |
| 2007/0057873 | A1 | 3/2007 | Uchino et al. |
| 2007/0057874 | A1 | 3/2007 | Le Roy et al. |
| 2007/0063932 | A1 | 3/2007 | Nathan et al. |
| 2007/0075957 | A1 | 4/2007 | Chen |
| 2007/0080908 | A1 | 4/2007 | Nathan et al. |
| 2007/0085801 | A1 | 4/2007 | Park et al. |
| 2007/0109232 | A1 | 5/2007 | Yamamoto et al. |
| 2007/0128583 | A1 | 6/2007 | Miyazawa |
| 2007/0164941 | A1 | 7/2007 | Park et al. |
| 2007/0182671 | A1 | 8/2007 | Nathan et al. |
| 2007/0236430 | A1 | 10/2007 | Fish |
| 2007/0236440 | A1 | 10/2007 | Wacyk et al. |
| 2007/0241999 | A1 | 10/2007 | Lin |
| 2007/0242008 | A1 | 10/2007 | Cummings |
| 2008/0001544 | A1 | 1/2008 | Murakami et al. |
| 2008/0043044 | A1 | 2/2008 | Woo et al. |
| 2008/0048951 | A1 | 2/2008 | Naugler et al. |
| 2008/0055134 | A1 | 3/2008 | Li et al. |
| 2008/0062106 | A1 | 3/2008 | Tseng |
| 2008/0074360 | A1 | 3/2008 | Lu et al. |
| 2008/0088549 | A1 | 4/2008 | Nathan et al. |
| 2008/0094426 | A1 | 4/2008 | Kimpe |
| 2008/0111766 | A1 | 5/2008 | Uchino et al. |
| 2008/0122819 | A1 | 5/2008 | Cho et al. |
| 2008/0129906 | A1 | 6/2008 | Lin et al. |
| 2008/0198103 | A1 | 8/2008 | Toyomura et al. |
| 2008/0228562 | A1 | 9/2008 | Smith et al. |
| 2008/0231625 | A1 | 9/2008 | Minami et al. |
| 2008/0231641 | A1 | 9/2008 | Miyashita |
| 2008/0265786 | A1 | 10/2008 | Koyama |
| 2008/0290805 | A1 | 11/2008 | Yamada et al. |
| 2009/0009459 | A1 | 1/2009 | Miyashita |
| 2009/0015532 | A1 | 1/2009 | Katayama et al. |
| 2009/0058789 | A1 | 3/2009 | Hung et al. |
| 2009/0121988 | A1 | 5/2009 | Amo et al. |
| 2009/0146926 | A1 | 6/2009 | Sung et al. |
| 2009/0153448 | A1 | 6/2009 | Tomida et al. |
| 2009/0153459 | A9 | 6/2009 | Han et al. |
| 2009/0174628 | A1 | 7/2009 | Wang et al. |
| 2009/0201230 | A1 | 8/2009 | Smith |
| 2009/0201281 | A1 | 8/2009 | Routley et al. |
| 2009/0206764 | A1 | 8/2009 | Schemmann et al. |
| 2009/0219232 | A1 | 9/2009 | Choi |
| 2009/0244046 | A1 | 10/2009 | Seto |
| 2009/0251486 | A1 | 10/2009 | Sakakibara et al. |
| 2009/0278777 | A1 | 11/2009 | Wang et al. |
| 2009/0289964 | A1 | 11/2009 | Miyachi |
| 2009/0295423 | A1 | 12/2009 | Levey |
| 2010/0033469 | A1 | 2/2010 | Nathan |
| 2010/0039451 | A1 | 2/2010 | Jung |
| 2010/0039453 | A1 | 2/2010 | Nathan et al. |
| 2010/0045646 | A1 | 2/2010 | Kishi |
| 2010/0079419 | A1 | 4/2010 | Shibusawa |
| 2010/0134475 | A1 | 6/2010 | Ogura |
| 2010/0207920 | A1 | 8/2010 | Chaji et al. |
| 2010/0225634 | A1 | 9/2010 | Levey et al. |
| 2010/0251295 | A1 | 9/2010 | Amento et al. |
| 2010/0269889 | A1 | 10/2010 | Reinhold et al. |
| 2010/0277400 | A1 | 11/2010 | Jeong |
| 2010/0315319 | A1 | 12/2010 | Cok et al. |
| 2010/0315449 | A1 | 12/2010 | Chaji |
| 2011/0050741 | A1 | 3/2011 | Jeong |
| 2011/0063197 | A1 | 3/2011 | Chung et al. |
| 2011/0069089 | A1 | 3/2011 | Kopf et al. |
| 2011/0074762 | A1 | 3/2011 | Shirasaki |
| 2011/0109350 | A1 | 5/2011 | Chaji et al. |
| 2011/0191042 | A1 | 8/2011 | Chaji |
| 2011/0205221 | A1 | 8/2011 | Lin |
| 2012/0169793 | A1 | 7/2012 | Nathan |
| 2012/0299976 | A1 | 11/2012 | Chen et al. |
| 2012/0299978 | A1 | 11/2012 | Chaji |
| 2014/0267215 | A1 | 9/2014 | Soni |

FOREIGN PATENT DOCUMENTS

| | | | |
|---|---|---|---|
| CA | 1 294 034 | | 1/1992 |
| CA | 2 249 592 | | 7/1998 |
| CA | 2 303 302 | | 3/1999 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 507 276 | | 8/2002 |
| CA | 2 463 653 | | 1/2004 |
| CA | 2 498 136 | | 3/2004 |
| CA | 2 522 396 | | 11/2004 |
| CA | 2 438 363 | | 2/2005 |
| CA | 2 443 206 | | 3/2005 |
| CA | 2 519 097 | | 3/2005 |
| CA | 2 472 671 | | 12/2005 |
| CA | 2 523 841 | | 1/2006 |
| CA | 2 567 076 | | 1/2006 |
| CA | 2 495 726 | | 7/2006 |
| CA | 2 557 713 | | 11/2006 |
| CA | 2 526 782 | C | 8/2007 |
| CA | 2 651 893 | | 11/2007 |
| CA | 2 672 590 | | 10/2009 |
| CN | 1601594 | A | 3/2005 |
| CN | 1886774 | | 12/2006 |
| DE | 202006007613 | | 9/2006 |
| EP | 0 478 186 | | 4/1992 |
| EP | 1 028 471 | A | 8/2000 |
| EP | 1 130 565 | A1 | 9/2001 |
| EP | 1 194 013 | | 4/2002 |
| EP | 1 321 922 | | 6/2003 |
| EP | 1 335 430 | A1 | 8/2003 |
| EP | 1 381 019 | | 1/2004 |
| EP | 1 429 312 | A | 6/2004 |
| EP | 1 439 520 | A2 | 7/2004 |
| EP | 1 465 143 | A | 10/2004 |
| EP | 1 473 689 | A | 11/2004 |
| EP | 1 517 290 | A2 | 3/2005 |
| EP | 1 521 203 | A2 | 4/2005 |
| GB | 2 399 935 | | 9/2004 |
| GB | 2 460 018 | | 11/2009 |
| JP | 09 090405 | | 4/1997 |
| JP | 10-254410 | | 9/1998 |
| JP | 11 231805 | | 8/1999 |
| JP | 2002-278513 | | 9/2002 |
| JP | 2003-076331 | | 3/2003 |
| JP | 2003-099000 | | 4/2003 |

(56) References Cited

FOREIGN PATENT DOCUMENTS

| | | |
|---|---|---|
| JP | 2003-173165 | 6/2003 |
| JP | 2003-186439 | 7/2003 |
| JP | 2003-195809 | 7/2003 |
| JP | 2003-271095 | 9/2003 |
| JP | 2003-308046 | 10/2003 |
| JP | 2004-054188 | 2/2004 |
| JP | 2004-226960 | 8/2004 |
| JP | 2005-004147 | 1/2005 |
| JP | 2005-099715 | 4/2005 |
| JP | 2005-258326 | 9/2005 |
| JP | 2005-338819 | 12/2005 |
| TW | 569173 | 1/2004 |
| TW | 200526065 | 8/2005 |
| TW | 1239501 | 9/2005 |
| WO | WO 98/11554 | 3/1998 |
| WO | WO 99/48079 | 9/1999 |
| WO | WO 01/27910 A1 | 4/2001 |
| WO | WO 02/067327 A | 8/2002 |
| WO | WO 03/034389 | 4/2003 |
| WO | WO 03/063124 | 7/2003 |
| WO | WO 03/075256 | 9/2003 |
| WO | WO 2004/003877 | 1/2004 |
| WO | WO 2004/015668 A1 | 2/2004 |
| WO | WO 2004/034364 | 4/2004 |
| WO | WO 2005/022498 | 3/2005 |
| WO | WO 2005/055185 | 6/2005 |
| WO | WO 2005/055186 A1 | 6/2005 |
| WO | WO 2005/069267 | 7/2005 |
| WO | WO 2005/122121 | 12/2005 |
| WO | WO 2006/063448 | 6/2006 |
| WO | WO 2006/128069 | 11/2006 |
| WO | WO 2008/057369 | 5/2008 |
| WO | WO 2009/059028 | 5/2009 |
| WO | WO 2009/127065 | 10/2009 |
| WO | WO 2010/066030 | 6/2010 |
| WO | WO 2010/120733 | 10/2010 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation Inspection and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~0~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High- Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated May 2008 (177 pages).
Chapter 3: Color Spaces"Keith Jack:" Video Demystified: "A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies; Willem den Boer: "Active Matrix Liquid Crystal Display: Fundamentals and Applications" 2005 Referex ORD-0000-00-00 U.K.; XP040426102 ISBN: 0-7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2 dated Aug. 18, 2009 (12 pages).
European Search Report Application No. 10 83 4294.0-1903 dated Apr. 8, 2013 (9 pages).
European Search Report Application No. EP 05 80 7905 dated Apr. 2, 2009 (5 pages).
European Search Report Application No. EP 05 82 1114 dated Mar. 27, 2009 (2 pages).
European Search Report Application No. EP 07 70 1644 dated Aug. 5, 2009.
European Search Report Application No. EP 10 17 5764 dated Oct. 18, 2010 (2 pages).
European Search Report Application No. EP 10 82 9593.2 European Patent Office dated May 17, 2013 (7 pages).
European Search Report Application No. EP 12 15 6251.6 European Patent Office dated Oct. 12, 2012 (18 pages).
European Search Report Application No. EP. 11 175 225.9 dated Nov. 4, 2011 (9 pages).

(56) References Cited

OTHER PUBLICATIONS

European Supplementary Search Report Application No. EP 09 80 2309 dated May 8, 2011 (14 pages).
European Supplementary Search Report Application No. EP 09 83 1339.8 dated Mar. 26, 2012 (11 pages).
Extended European Search Report Application No. EP 06 75 2777.0 dated Dec. 6, 2010 (21 pages).
Extended European Search Report Application No. EP 09 73 2338.0 dated May 24, 2011 (8 pages).
Extended European Search Report Application No. EP 11 17 5223., 4 mailed Nov. 8, 2011 (8 pages).
Extended European Search Report Application No. EP 12 17 4465.0 European Patent Office dated Sep. 7, 2012 (9 pages).
Fan et al. "LTPS_TFT Pixel Circuit Compensation for TFT Threshold Voltage Shift and IR-Drop on the Power Line for Amolded Displays" 5 pages copyright 2012.
Goh et al. "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007.
International Search Report Application No. PCT/CA2009/001049 mailed Dec. 7, 2009 (4 pages).
International Search Report Application No. PCT/CA2009/001769 dated Apr. 8, 2010.
International Search Report Application No. PCT/IB2010/002898 Canadian Intellectual Property Office dated Jul. 28, 2009 (5 pages).
International Search Report Application No. PCT/IB2010/055481 dated Apr. 7, 2011 (3 pages).
International Search Report Application No. PCT/IB2011/051103 dated Jul. 8, 2011 3 pages.
International Search Report Application No. PCT/IB2012/052651 5 pages dated Sep. 11, 2012.
International Searching Authority Written Opinion Application No. PCT/IB2010/055481 dated Apr. 7, 2011 (6 pages ).
International Searching Authority Written Opinion Application No. PCT/IB2012/052651 6 pages dated Sep. 11, 2012.
International Searching Authority Written Opinion Application No. PCT/IB2011/051103 dated Jul. 8, 2011 6 pages.
International Searching Authority Written Opinion Application No. PCT/IB2010/002898 Canadian Intellectual Property Office dated Mar. 30, 2011 (8 pages).
International Searching Authority Written Opinion Application No. PCT/CA2009/001769 dated Apr. 8, 2010 (8 pages).
Jafarabadiashtiani et al.: "A New Driving Method for a-Si AMOLED Displays Based on Voltage Feedback"; dated May 2005 (4 pages).
Lee et al.: "Ambipolar Thin-Film Transistors Fabricated by PECVD Nanocrystalline Silicon"; dated May 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto Sep. 15-19, 1997 (6 pages).
Matsueda y et al.: "35.1: 2.5-in. AMOLED with Integrated 6-bit Gamma Compensated Digital Data Driver"; dated May 2004 (4 pages).
Nathan et al. "Amorphous Silicon Thin Film Transistor Circuit Integration for Organic LED Displays on Glass and Plastic" IEEE Journal of Solid-State Circuits vol. 39 No. 9 Sep. 2004 pp. 1477-1486.
Nathan et al.: "Backplane Requirements for Active Matrix Organic Light Emitting Diode Displays"; dated Sep. 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated Jun. 2006 (4 pages).
Nathan et al.: "Thin film imaging technology on glass and plastic"; dated Oct. 31-Nov. 2, 2000 (4 pages).
Ono et al. "Shared Pixel Compensation Circuit for AM-OLED Displays" Proceedings of the 9th Asian Symposium on Information Display (ASID) pp. 462-465 New Delhi dated Oct. 8-12, 2006 (4 pages).
Philipp: "Charge transfer sensing" Sensor Review vol. 19 No. 2 Dec. 31, 1999 (Dec. 31, 1999) 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Smith, Lindsay I., "A tutorial on Principal Components Analysis," dated Feb. 26, 2001 (27 pages).
Stewart M. et al. "Polysilicon TFT technology for active matrix OLED displays" IEEE transactions on electron devices vol. 48 No. 5 May 2001 (7 pages).
Vygranenko et al.: "Stability of indium-oxide thin-film transistors by reactive ion beam assisted deposition"; dated Feb. 2009.
Wang et al.: "Indium oxides by reactive ion beam assisted evaporation: From material study to device application," dated Mar. 2009 (6 pages).
Yi He et al. "Current-Source a-Si:H Thin Film Transistor Circuit for Active-Matrix Organic Light-Emitting Displays" IEEE Electron Device Letters vol. 21 No. 12 Dec. 2000 pp. 590-592.
International Search Report Application No. PCT/IB2013/059074, dated Dec. 18, 2013 (5 pages).
International Searching Authority Written Opinion Application No. PCT/IB2013/059074, dated Dec. 18, 2013 (8 pages ).

METHOD AND SYSTEM FOR PROGRAMMING AND DRIVING ACTIVE MATRIX LIGHT EMITTING DEVICE PIXEL HAVING A CONTROLLABLE SUPPLY VOLTAGE

CROSS REFERENCE TO RELATED APPLICATIONS

This application is a continuation of U.S. patent application Ser. No. 13/744,843, filed Jan. 18, 2013, now allowed, which is a continuation of U.S. patent application Ser. No. 13/243,065, filed Sep. 23, 2011, now issued as U.S. Pat. No. 8,378,938, which is a continuation of U.S. patent application Ser, No. 12/851,652, filed Aug. 6, 2010; now issued as U.S. Pat. No. 8,405,587, which is a continuation of U.S. patent application Ser. No. 11/298,240, filed Dec. 7, 2005, now issued as U.S. Pat. No. 7,800,565, which claims priority to Canadian Patent No. 2,490,858, filed Dec. 7, 2004, each of which is incorporated herein by reference in its entirety.

FIELD OF INVENTION

The present invention relates to a light emitting device displays, and more specifically to a driving technique for the light emitting device displays.

BACKGROUND OF THE INVENTION

Recently active-matrix organic light-emitting diode (AMOLED) displays with amorphous silicon (a-Si), polysilicon, organic, or other driving backplane have become more attractive due to advantages over active matrix liquid crystal displays. An AMOLED display using a-Si backplanes, for example, has the advantages which include low temperature fabrication that broadens the use of different substrates and makes flexible displays feasible, and its low cost fabrication that yields high resolution displays with a wide viewing angle.

The AMOLED display includes an array of rows and columns of pixels, each having an organic light-emitting diode (OLED) and backplane electronics arranged in the array of rows and columns. Since the OLED is a current driven device, the pixel circuit of the AMOLED should be capable of providing an accurate and constant drive current.

FIG. 1 shows a pixel circuit as disclosed in U.S. Pat. No. 5,748,160. The pixel circuit of FIG. 1 includes an OLED 10, a driving thin film transistor (TFT) 11, a switch TFT 13, and a storage capacitor 14. The drain terminal of the driving TFT 11 is connected to the OLED 10. The gate terminal of the driving TFT 11 is connected to a column line 12 through the switch TFT 13. The storage capacitor 14, which is connected between the gate terminal of the driving TFT 11 and the ground, is used to maintain the voltage at the gate terminal of the driving TFT 11 when the pixel circuit is disconnected from the column line 12. The current through the OLED 10 strongly depends on the characteristic parameters of the driving TFT 11. Since the characteristic parameters of the driving TFT 11, in particular the threshold voltage under bias stress, vary by time, and such changes may differ from pixel to pixel, the induced image distortion may be unacceptably high.

U.S. Pat. No. 6,229,508 discloses a voltage-programmed pixel circuit which provides, to an OLED, a current independent of the threshold voltage of a driving TFT. In this pixel, the gate-source voltage of the driving TFT is composed of a programming voltage and the threshold voltage of the driving TFT. A drawback of U.S. Pat. No. 6,229,508 is that the pixel circuit requires extra transistors, and is complex, which results in a reduced yield, reduced pixel aperture, and reduced lifetime for the display.

Another method to make a pixel circuit less sensitive to a shift in the threshold voltage of the driving transistor is to use current programmed pixel circuits, such as pixel circuits disclosed in U.S. Pat. No. 6,734,636. In the conventional current programmed pixel circuits, the gate-source voltage of the driving TFT is self-adjusted based on the current that flows through it in the next frame, so that the OLED current is less dependent on the current-voltage characteristics of the driving TFT. A drawback of the current-programmed pixel circuit is that an overhead associated with low programming current levels arises from the column line charging time due to the large line capacitance.

SUMMARY OF THE INVENTION

It is an object of the invention to provide a method and system that obviates or mitigates at least one of the disadvantages of existing systems.

In accordance with an aspect to the present invention there is provided a method of programming and driving a display system, the display system includes: a display array having a plurality of pixel circuits arranged in row and column, each pixel circuit having: a light emitting device having a first terminal and a second terminal, the first terminal of the lighting device being connected to a voltage supply electrode; a capacitor having a first terminal and a second terminal; a switch transistor having a gate terminal, a first terminal and a second terminal, the gate terminal of the switch transistor being connected to a select line, the first terminal of the switch transistor being connected to a signal line for transferring voltage data, the second terminal of the switch transistor being connected to the first terminal of the capacitor; and a driving transistor having a gate terminal, a first terminal and a second terminal, the gate terminal of the driving transistor being connected to the second terminal of the switch transistor and the first terminal of the capacitor at a first node (A), the first terminal of the driving transistor being connected to the second terminal of the light emitting device and the second terminal of the capacitor at a second node (B), the second terminal of the driving transistor being connected to a controllable voltage supply line; a driver for driving the select line, the controllable voltage supply line and the signal line to operate the display array; the method including the steps of: at a programming cycle, at a first operating cycle, charging the second node at a first voltage defined by (VREF−VT) or (−VREF+VT), where VREF represents a reference voltage and VT represents a threshold voltage of the driving transistor; at a second operating cycle, charging the first node at a second voltage defined by (VREF+VP) or (−VREF+VP) so that the difference between the first and second node voltages is stored in the storage capacitor, where VP represents a programming voltage; at a driving cycle, applying the voltage stored in the storage capacitor to the gate terminal of the driving transistor.

In accordance with a further aspect to the present invention there is provided a method of programming and driving a display system, the display system includes: a display array having a plurality of pixel circuits arranged in row and column, each pixel circuit having: a light emitting device having a first terminal and a second terminal, the first terminal of the lighting device being connected to a voltage supply electrode; a first capacitor and a second capacitor, each having a first terminal and a second terminal; a first switch transistor having a gate terminal, a first terminal and a second terminal, the gate terminal of the first switch transistor being connected to a first select line, the first terminal of the first switch transistor being connected to the second terminal of the light emitting device, the second terminal of the first switch being connected to the first terminal of the first capacitor; a second switch transistor having a gate terminal, a first terminal and a second terminal, the gate terminal of the second switch transistor being connected to a second select line, the first terminal of the second switch transistor being connected to a signal line for transferring voltage data; a driving transistor having a gate terminal, a first terminal and a second terminal, the first terminal of the driving transistor being connected to the second terminal of the light emitting device at a first node (A), the gate terminal of the driving transistor being connected to the second terminal of the first switch transistor and the first terminal of the first capacitor at a second node (B), the second terminal of the driving transistor being connected to a controllable voltage supply line; the second terminal of the second switch transistor being connected to the second terminal of the first capacitor and the first terminal of the second capacitor at a third node (C); a driver for driving the first and second select line, the controllable voltage supply line and the signal line to operate the display array, the method including the steps of: at a programming cycle, at a first operating cycle, controlling the voltage of each of the first node and the second node so as to store (VT+VP) or −(VT+VP) in the first storage capacitor, where VT represents a threshold voltage of the driving transistor, VP represents a programming voltage; at a second operating cycle, discharging the third node; at a driving cycle, applying the voltage stored in the storage capacitor to the gate terminal of the driving transistor.

In accordance with a further aspect to the present invention there is provided a display system including: a display array having a plurality of pixel circuits arranged in row and column, each pixel circuit having: a light emitting device having a first terminal and a second terminal, the first terminal of the lighting device being connected to a voltage supply electrode; a capacitor having a first terminal and a second terminal; a switch transistor having a gate terminal, a first terminal and a second terminal, the gate terminal of the switch transistor being connected to a select line, the first terminal of the switch transistor being connected to a signal line for transferring voltage data, the second terminal of the switch transistor being connected to the first terminal of the capacitor; and a driving transistor having a gate terminal, a first terminal and a second terminal, the gate terminal of the driving transistor being connected to the second terminal of the switch transistor and the first terminal of the capacitor at a first node (A), the first terminal of the driving transistor being connected to the second terminal of the light emitting device and the second terminal of the capacitor at a second node (B), the second terminal of the driving transistor being connected to a controllable voltage supply line; a driver for driving the select line, the controllable voltage supply line and the signal line to operate the display array; and a controller for implementing a programming cycle and a driving cycle on each row of the display array using the driver; wherein the programming cycle includes a first operating cycle and a second operating cycle, wherein at the first operating cycle, the second node is charged at a first voltage defined by (VREF−VT) or (−VREF+VT), where VREF represents a reference voltage and VT represents a threshold voltage of the driving transistor, at the second operating cycle, the first node is charged at a second voltage defined by (VREF+VP) or (−VREF+VP) so that the difference between the first and second node voltages is stored in the storage capacitor, where VP represents a programming voltage; wherein at the driving cycle, the voltage stored in the storage capacitor is applied to the gate terminal of the driving transistor.

In accordance with a further aspect to the present invention there is provided a display system including: a display array having a plurality of pixel circuits arranged in row and column, each pixel circuit having: a light emitting device having a first terminal and a second terminal, the first terminal of the lighting device being connected to a voltage supply electrode; a first capacitor and a second capacitor, each having a first terminal and a second terminal; a first switch transistor having a gate terminal, a first terminal and a second terminal, the gate terminal of the first switch transistor being connected to a first select line, the first terminal of the first switch transistor being connected to the second terminal of the light emitting device, the second terminal of the first switch being connected to the first terminal of the first capacitor; a second switch transistor having a gate terminal, a first terminal and a second terminal, the gate terminal of the second switch transistor being connected to a second select line, the first terminal of the second switch transistor being connected to a signal line for transferring voltage data; a driving transistor having a gate terminal, a first terminal and a second terminal, the first terminal of the driving transistor being connected to the second terminal of the light emitting device at a first node (A), the gate terminal of the driving transistor being connected to the second terminal of the first switch transistor and the first terminal of the first capacitor at a second node (B), the second terminal of the driving transistor being connected to a controllable voltage supply line; the second terminal of the second switch transistor being connected to the second terminal of the first capacitor and the first terminal of the second capacitor at a third node (C); a driver for driving the first and second select line, the controllable voltage supply line and the signal line to operate the display array; and a controller for implementing a programming cycle and a driving cycle on each row of the display array using the driver; wherein the programming cycle includes a first operating cycle and a second operating cycle, wherein at the first operating cycle, the voltage of each of the first node and the second node is controlled so as to store (VT+VP) or −(VT+VP) in the first storage capacitor, where VT represents a threshold voltage of the driving transistor, VP represents a programming voltage, at the second operating cycle, the third node is discharged, wherein at the driving cycle, the voltage stored in the storage capacitor is applied to the gate terminal of the driving transistor.

This summary of the invention does not necessarily describe all features of the invention.

Other aspects and features of the present invention will be readily apparent to those skilled in the art from a review of the following detailed description of preferred embodiments in conjunction with the accompanying drawings.

BRIEF DESCRIPTION OF THE DRAWINGS

These and other features of the invention will become more apparent from the following description in which reference is made to the appended drawings wherein:

FIG. 7(*b*) is a diagram showing an example of the array structure having bottom emission pixels which are applicable to the array of FIG. 6;

DETAILED DESCRIPTION OF THE PREFERRED EMBODIMENTS OF THE INVENTION

Embodiments of the present invention are described using a pixel having an organic light emitting diode (OLED) and a driving thin film transistor (TFT). However, the pixel may include any light emitting device other than OLED, and the pixel may include any driving transistor other than TFT. It is noted that in the description, "pixel circuit" and "pixel" may be used interchangeably.

Figure 1:
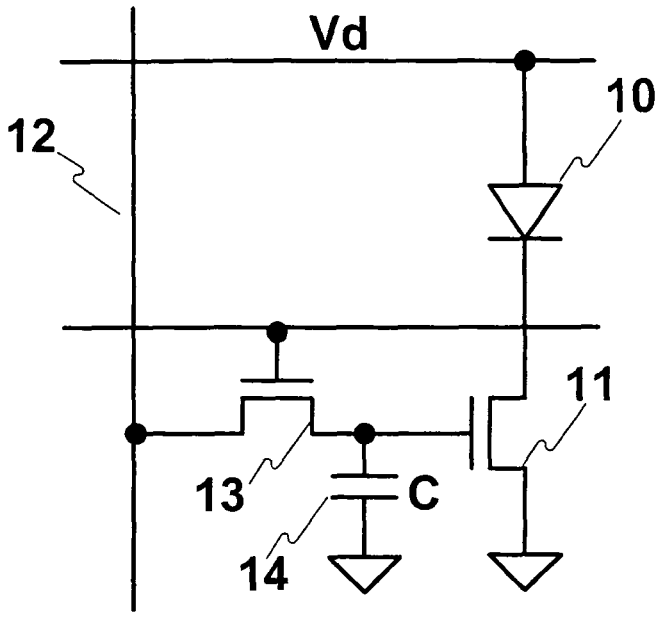
Figure 1 Prior Art
FIG. 1 is a diagram showing a conventional 2-TFT voltage programmed pixel circuit.
Figure 2:
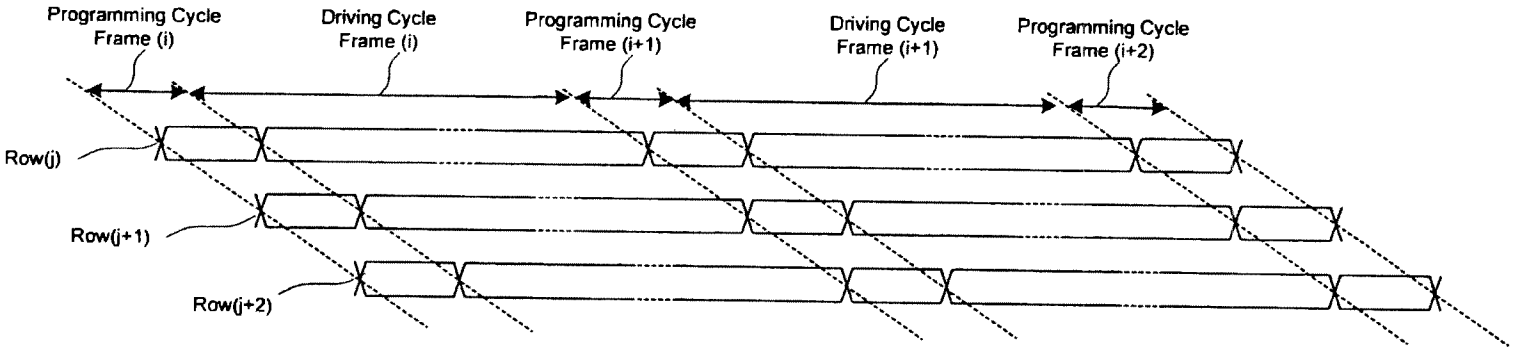
FIG. 2 is a timing diagram showing an example of programming and driving cycles in accordance with an embodiment of the present invention, which is applied to a display array.

FIG. 2 is a diagram showing programming and driving cycles in accordance with an embodiment of the present invention. In FIG. 2, each of ROW(j), ROW(j+1), and ROW(j+2) represents a row of the display array where a plurality of pixel circuits are arranged in row and column.

The programming and driving cycle for a frame occurs after the programming and driving cycle for a next frame. The programming and driving cycles for the frame at a ROW overlaps with the programming and driving cycles for the same frame at a next ROW. As described below, during the programming cycle, the time depending parameter(s) of the pixel circuit is extracted to generate a stable pixel current.

Figure 3:
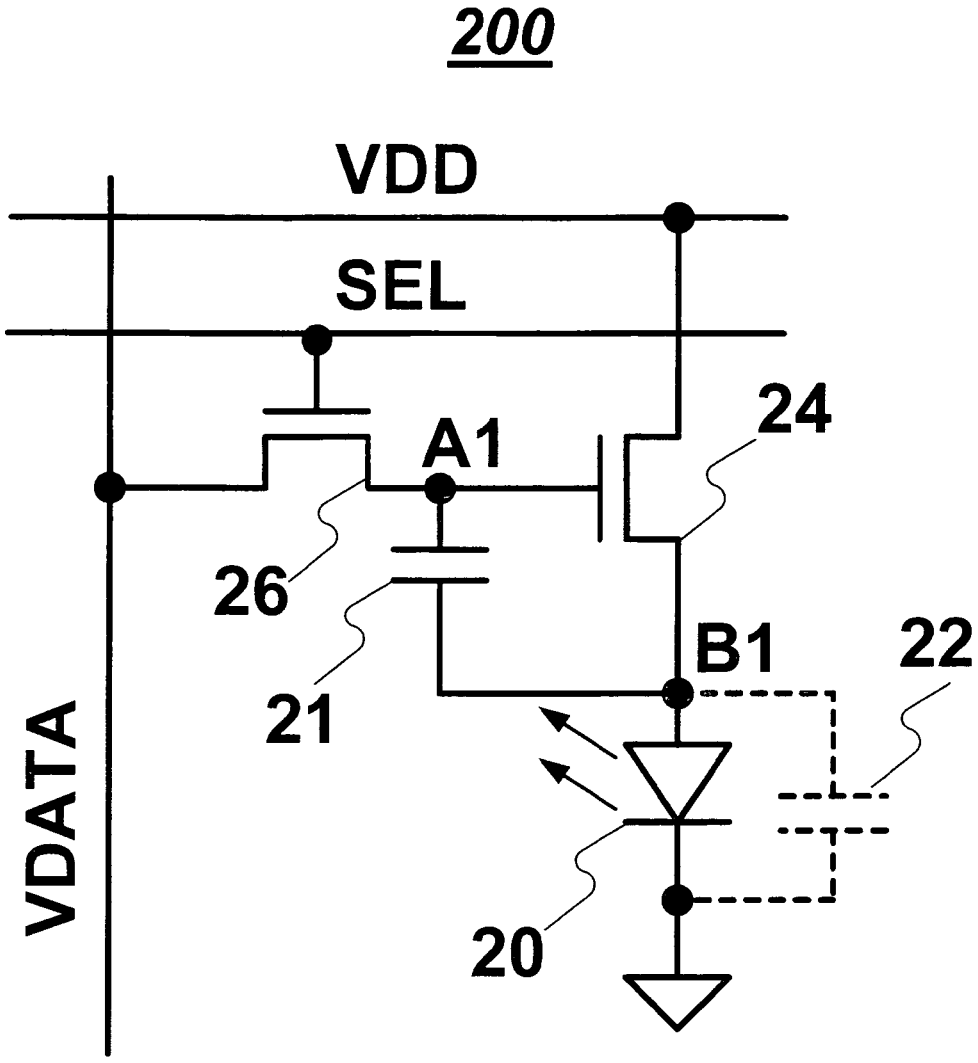
FIG. 3 is a diagram showing a pixel circuit to which programming and driving technique in accordance with an embodiment of the present invention is applied.

FIG. 3 illustrates a pixel circuit 200 to which programming and driving technique in accordance with an embodiment of the present invention is applied. The pixel circuit 200 includes an OLED 20, a storage capacitor 21, a driving transistor 24, and a switch transistor 26. The pixel circuit 200 is a voltage programmed pixel circuit. Each of the transistors 24 and 26 has a gate terminal, a first terminal and a second terminal. In the description, the first terminal (second terminal) may be, but not limited to, a drain terminal or a source terminal (a source terminal or a drain terminal).

Figure 14:
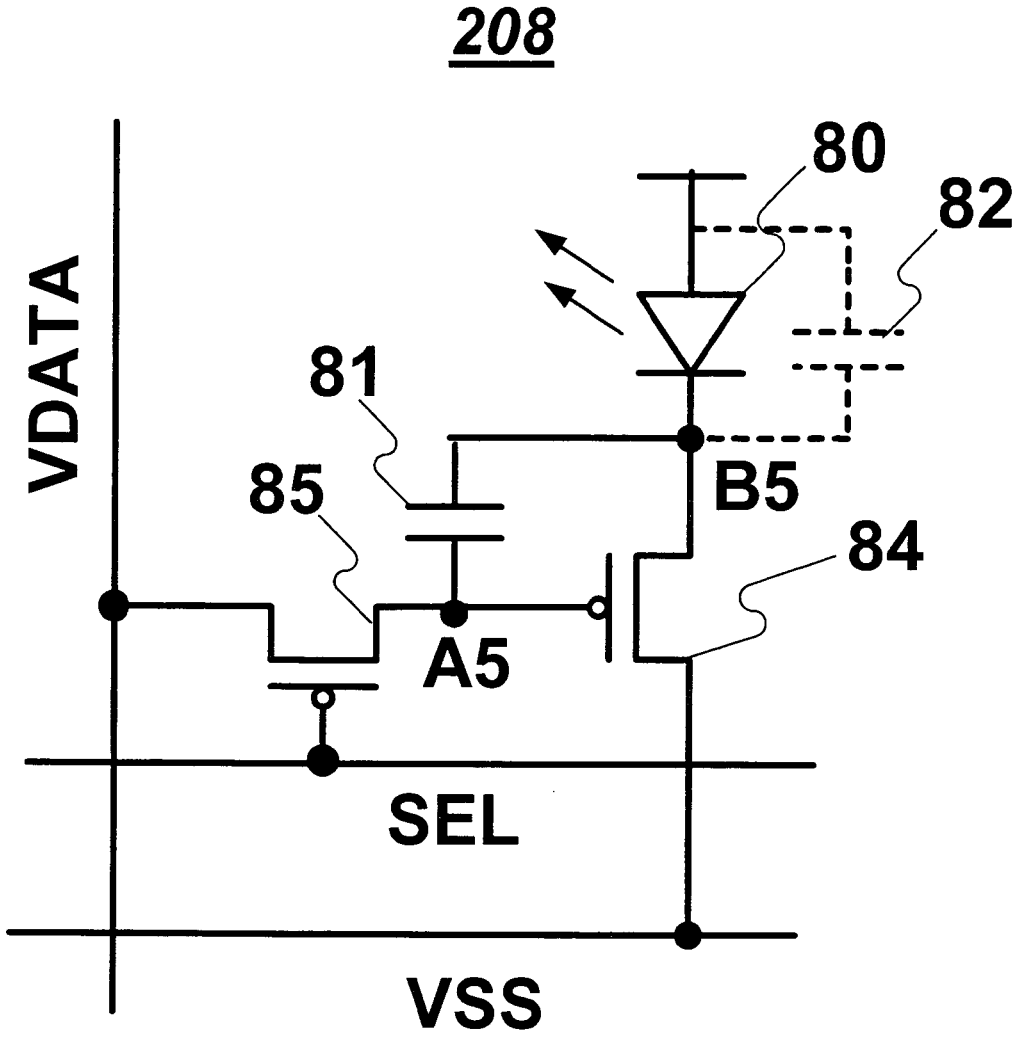
FIG. 14 is a diagram showing a pixel circuit to which programming and driving technique in accordance with a further embodiment of the present invention is applied.

The transistors 24 and 26 are n-type TFTs. However, the transistors 24 and 26 may be p-type transistors. As described below, the driving technique applied to the pixel circuit 200 is also applicable to a complementary pixel circuit having p-type transistors as shown in FIG. 14. The transistors 24 and 26 may be fabricated using amorphous silicon, nano/micro crystalline silicon, poly silicon, organic semiconductors technologies (e.g. organic TFT), NMOS/PMOS technology or CMOS technology (e.g. MOSFET).

The first terminal of the driving transistor 24 is connected to a controllable voltage supply line VDD. The second terminal of the driving transistor 24 is connected to the anode electrode of the OLED 20. The gate terminal of the driving transistor 24 is connected to a signal line VDATA through the switch transistor 26. The storage capacitor 21 is connected between the source and gate terminals of the driving transistor 24.

The gate terminal of the switch transistor 26 is connected to a select line SEL. The first terminal of the switch transistor 26 is connected to the signal line VDATA. The second terminal of the switch transistor 26 is connected to the gate terminal of the driving transistor 24. The cathode electrode of the OLED 20 is connected to a ground voltage supply electrode.

The transistors 24 and 26 and the storage capacitor 21 are connected at node A1. The transistor 24, the OLED 20 and the storage capacitor 21 are connected at node B1.

Figure 4:
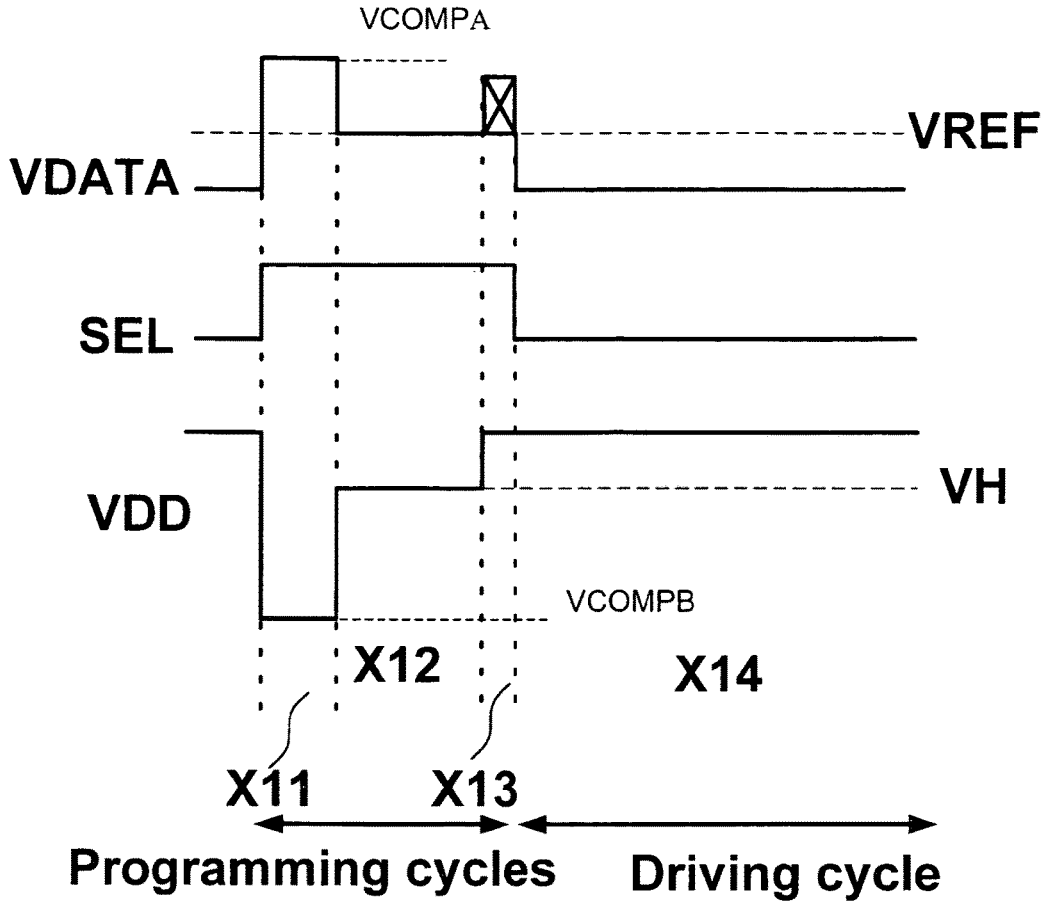
FIG. 4 is a timing diagram showing an example of waveforms for programming and driving the pixel circuit of FIG. 3.

FIG. 4 illustrates a timing diagram showing an example of waveforms for programming and driving the pixel circuit 200 of FIG. 3. Referring to FIGS. 3 and 4, the operation of the pixel circuit 200 includes a programming cycle having three operating cycles X11, X12 and X13, and a driving cycle having one operating cycle X14.

During the programming cycle, node B1 is charged to the negative threshold voltage of the driving transistor 24, and node A1 is charged to a programming voltage VP.

As a result, the gate-source voltage of the driving transistor 24 goes to:

$$VGS=VP-(-VT)=VP+VT \quad (1)$$

where VGS represents the gate-source voltage of the driving transistor 24, and VT represents the threshold voltage of the driving transistor 24.

Since the driving transistor 24 is in saturation regime of operation, its current is defined mainly by its gate-source voltage. As a result the current of the driving transistor 24 remains constant even if the OLED voltage changes, since its gate-source voltage is stored in the storage capacitor 21.

In the first operating cycle X11: VDD goes to a compensating voltage VCOMPB, and VDATA goes to a high positive compensating voltage VCOMPA, and SEL is high. As a result, node A1 is charged to VCOMPA and node B1 is charged to VCOMPB.

In the second operating cycle X12: While VDATA goes to a reference voltage VREF, node B1 is discharged through the driving transistor 24 until the driving transistor 24 turns off. As a result, the voltage of node B1 reaches (VREF−VT). VDD has a positive voltage VH to increase the speed of this cycle X12. For optimal setting time, VH can be set to be equal to the operating voltage which is the voltage on VDD during the driving cycle.

In the third operating cycle X13: VDD goes to its operating voltage. While SEL is high, node A1 is charged to (VP+VREF). Because the capacitance 22 of the OLED 20 is large, the voltage at node B1 stays at the voltage generated in the previous cycle X12. Thus, the voltage of node B1 is (VREF−VT). Therefore, the gate-source voltage of the driving transistor 24 is (VP+VT), and this gate-source voltage is stored in the storage capacitor 21.

In the fourth operating cycle X14: SEL and VDATA go to zero. VDD is the same as that of the third operating cycle X13. However, VDD may be higher than that of the third operating cycle X13. The voltage stored in the storage capacitor 21 is applied to the gate terminal of the driving transistor 24. Since the gate-source voltage of the driving transistor 24 include its threshold voltage and also is independent of the OLED voltage, the degradation of the OLED 20 and instability of the driving transistor 24 does not affect the amount of current flowing through the driving transistor 24 and the OLED 20.

It is noted that the pixel circuit 200 can be operated with different values of VCOMPB, VCOMPA, VP, VREF and VH. VCOMPB, VCOMPA, VP, VREF and VH define the lifetime of the pixel circuit 200. Thus, these voltages can be defined in accordance with the pixel specifications.

Figure 5:
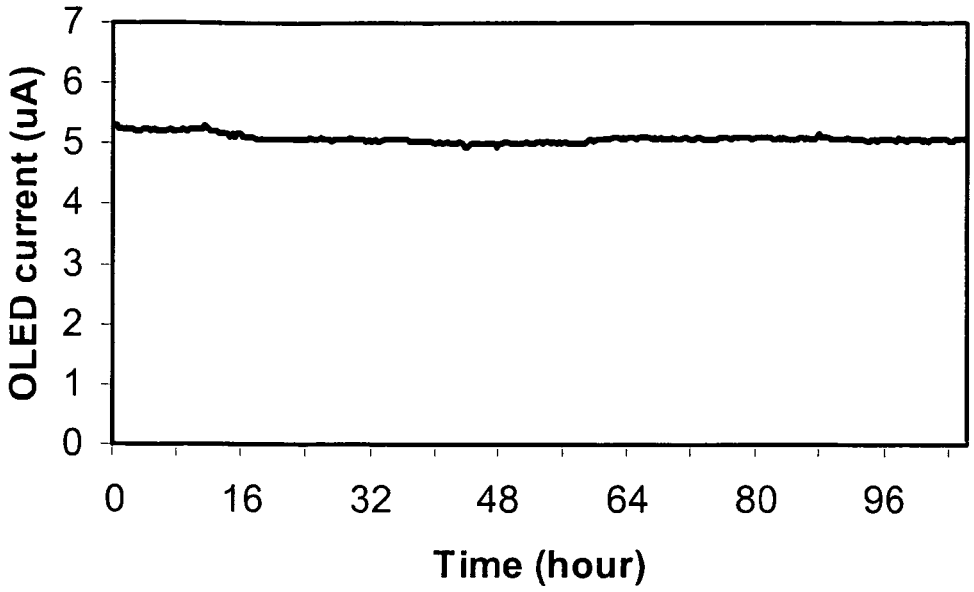
FIG. 5 is a diagram showing a lifetime test result for the pixel circuit of FIG. 3.

FIG. 5 illustrates a lifetime test result for the pixel circuit and waveform shown in FIGS. 3 and 4. In the test, a fabricated pixel circuit was put under the operation for a long time while the current of the driving transistor (24 of FIG. 3) was monitored to investigate the stability of the driving scheme. The result shows that OLED current is stable after 120-hour operation. The VT shift of the driving transistor is 0.7 V.

Figure 6:
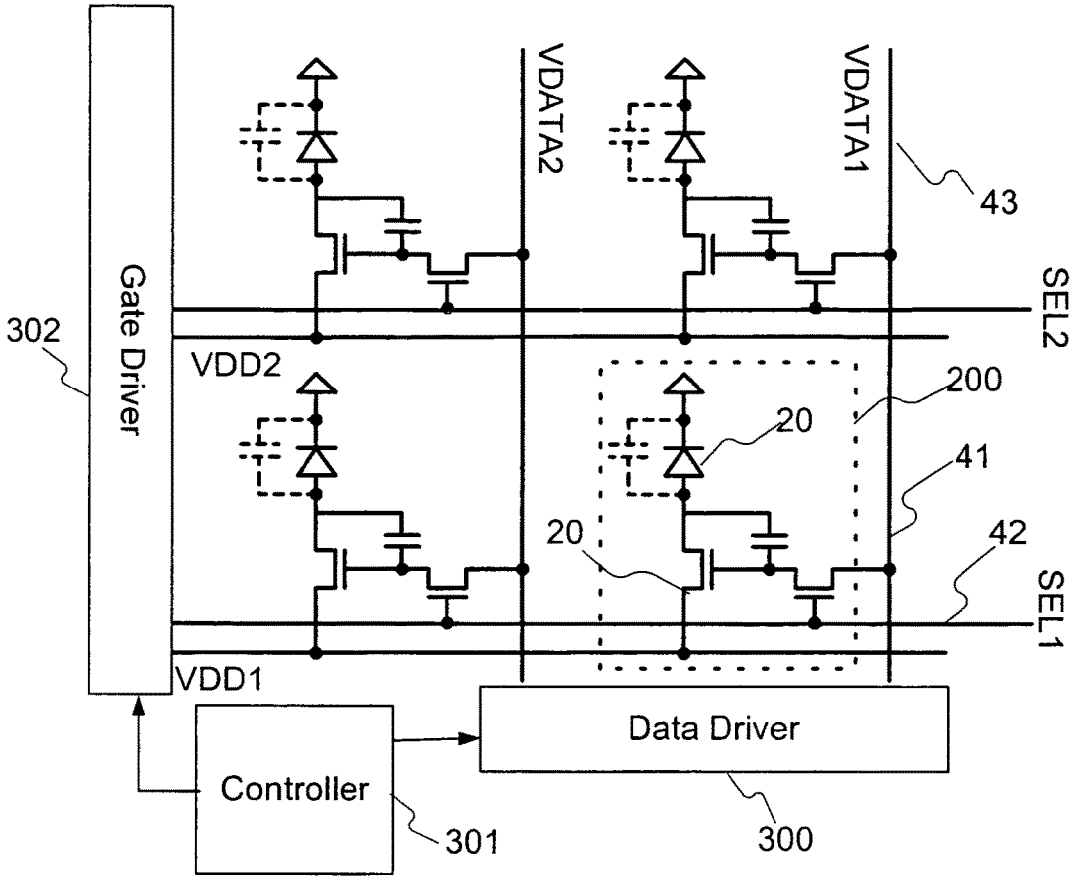
FIG. 6 is a diagram showing a display system having the pixel circuit of FIG. 3.

FIG. 6 illustrates a display system having the pixel circuit 200 of FIG. 3. VDD1 and VDD2 of FIG. 6 correspond to VDD of FIG. 3. SEL1 and SEL2 of FIG. 6 correspond to SEL of FIG. 3. VDATA1 and VDATA2 of FIG. 6 correspond to VDATA of FIG. 3. The array of FIG. 6 is an active matrix light emitting diode (AMOLED) display having a plurality of the pixel circuits 200 of FIG. 3. The pixel circuits are arranged in rows and columns, and interconnections 41, 42 and 43 (VDATA1, SEL1, VDD1). VDATA1 (or VDATA 2) is shared between the common column pixels while SEL1 (or SEL2) and VDD1 (or VDD2) are shared between common row pixels in the array structure.

A driver 300 is provided for driving VDATA1 and VDATA2. A driver 302 is provided for driving VDD1, VDD2, SEL1 and SEL2, however, the driver for VDD and SEL lines can also be implemented separately. A controller 304 controls the drivers 300 and 302 to programming and driving the pixel circuits as described above. The timing diagram for programming and driving the display array of FIG. 6 is as shown in FIG. 2. Each programming and driving cycle may be the same as that of FIG. 4.

Figure 7A:
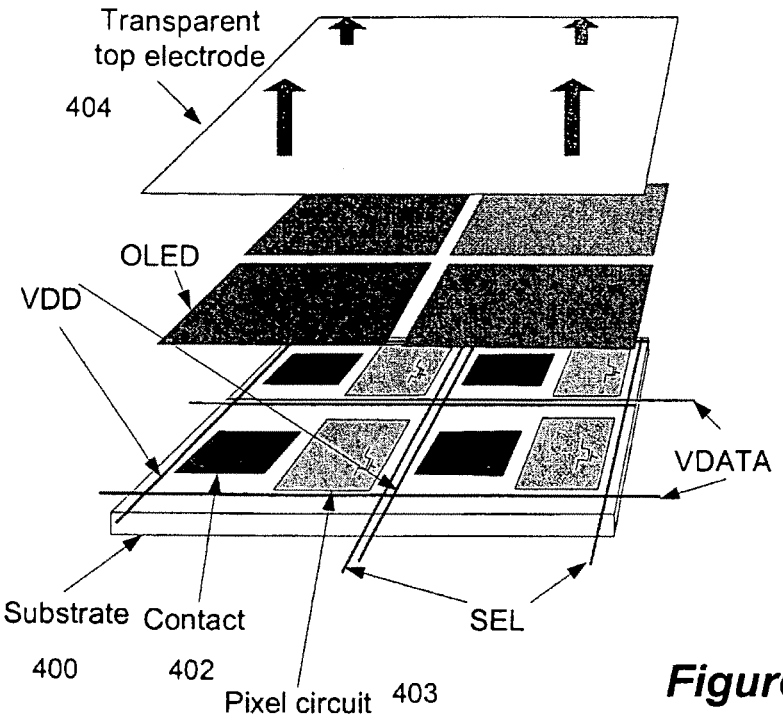
FIG. 7(*a*) is a diagram showing an example of the array structure having top emission pixels which are applicable to the array of FIG. 6.
Figure 7B:
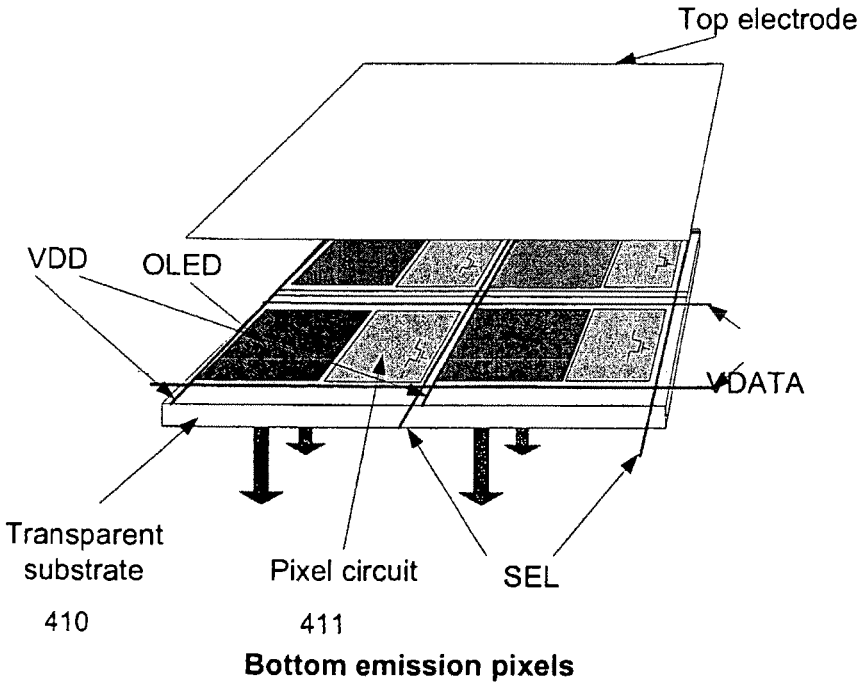

FIG. 7(*a*) illustrates an example of array structure having top emission pixels are arranged. FIG. 7(*b*) illustrates an example of array structure having bottom emission pixels are arranged. The array of FIG. 6 may have array structure shown in FIG. 7(*a*) or 7(*b*). In FIG. 7(*a*), 400 represents a substrate, 402 represents a pixel contact, 403 represents a (top emission) pixel circuit, and 404 represents a transparent top electrode on the OLEDs. In FIG. 7(*b*), 410 represents a transparent substrate, 411 represents a (bottom emission) pixel circuit, and 412 represents a top electrode. All of the pixel circuits including the TFTs, the storage capacitor, the SEL, VDATA, and VDD lines are fabricated together. After that, the OLEDs are fabricated for all pixel circuits. The OLED is connected to the corresponding driving transistor using a via (e.g. B1 of FIG. 3) as shown in FIGS. 7(*a*) and 7(*b*). The panel is finished by deposition of the top electrode on the OLEDs which can be a continuous layer, reducing the complexity of the design and can be used to turn the entire display ON/OFF or control the brightness.

Figure 8:
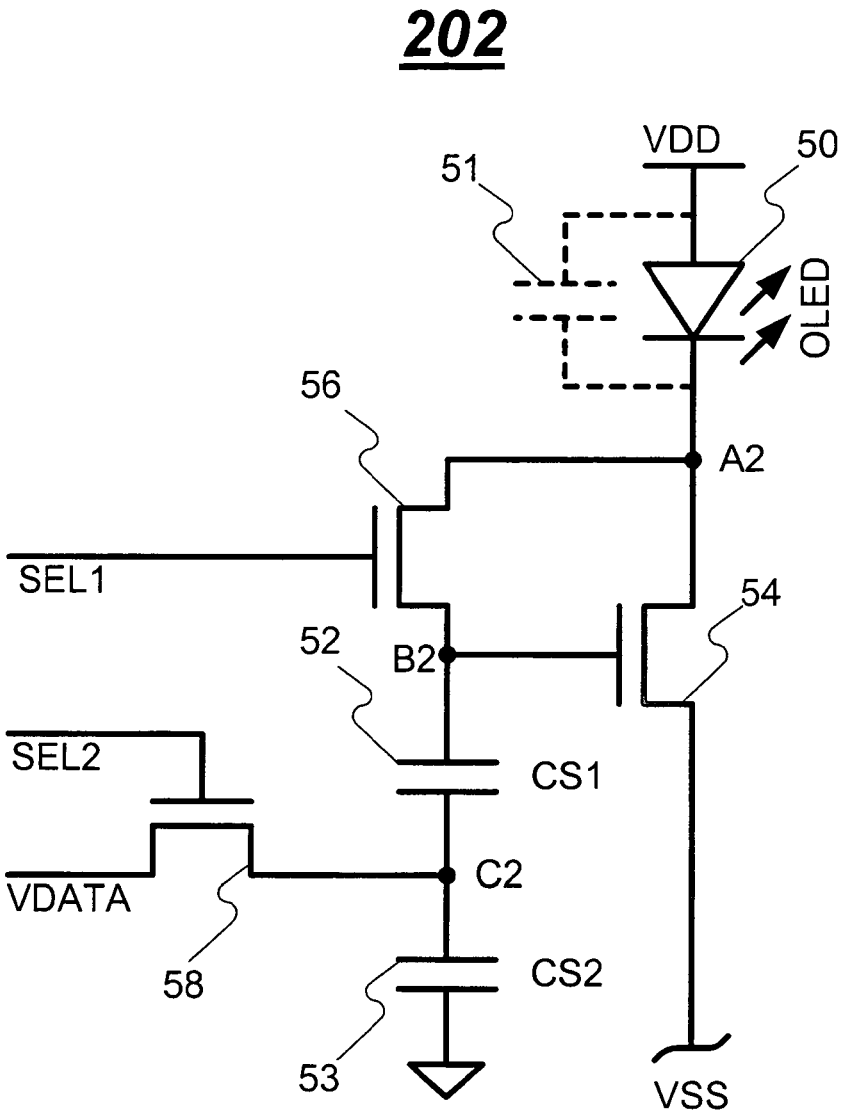
FIG. 8 is a diagram showing a pixel circuit to which programming and driving technique in accordance with a further embodiment of the present invention is applied.

FIG. 8 illustrates a pixel circuit 202 to which programming and driving technique in accordance with a further embodiment of the present invention is applied. The pixel circuit 202 includes an OLED 50, two storage capacitors 52 and 53, a driving transistor 54, and switch transistors 56 and 58. The pixel circuit 202 is a top emission, voltage programmed pixel circuit. This embodiment principally works in the same manner as that of FIG. 3. However, in the pixel circuit 202, the OLED 50 is connected to the drain terminal of the driving transistor 54. As a result, the circuit can be connected to the cathode Of the OLED 50. Thus, the OLED deposition can be started with the cathode.

Figure 17:
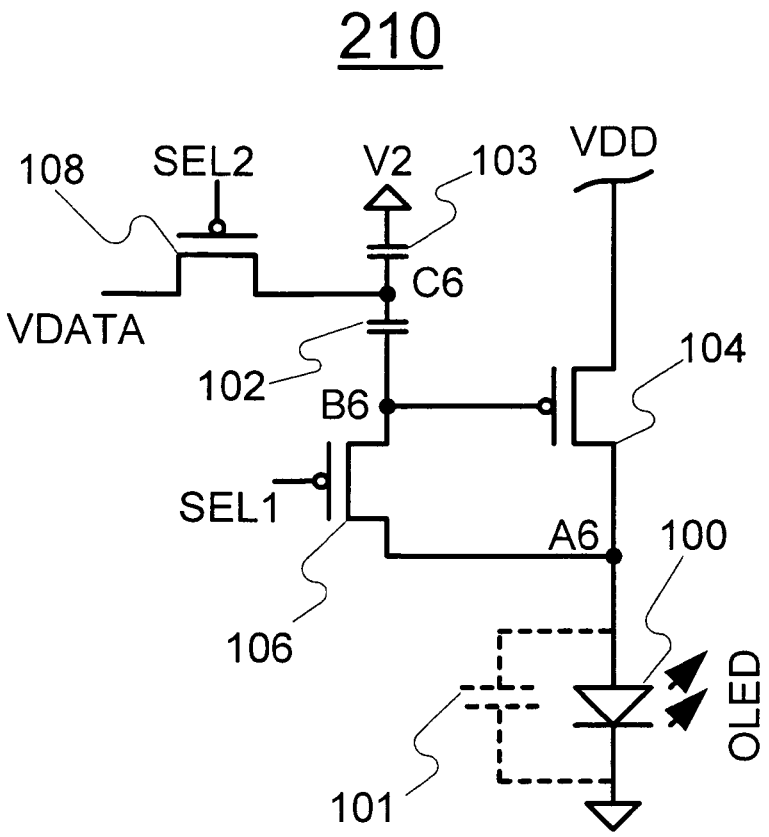
FIG. 17 is a diagram showing a pixel circuit to which programming and driving technique in accordance with a further embodiment of the present invention is applied.

The transistors 54, 56 and 58 are n-type TFTs. However, the transistors 54; 56 and 58 may be p-type transistors The driving technique applied to the pixel circuit 202 is also applicable to a complementary pixel circuit having p-type transistors as shown in FIG. 17. The transistors 54, 56 and 58 may be fabricated using amorphous silicon, nano/micro crystalline silicon, poly silicon, organic semiconductors technologies (e.g. organic TFT), NMOS/PMOS technology or CMOS technology (e.g. MOSFET).

The first terminal of the driving transistor 54 is connected to the cathode electrode of the OLED 50. The second terminal of the driving transistor 54 is connected to a controllable voltage supply line VSS. The gate terminal of the driving transistor 54 is connected to its first line (terminal) through the switch transistor 56. The storage capacitors 52 and 53 are in series, and are connected between the gate terminal of the driving transistor 54 and a common ground. The voltage on the voltage supply line VSS is controllable. The common ground may be connected to VSS.

The gate terminal of the switch transistor 56 is connected to a first select line SEL1. The first terminal of the switch transistor 56 is connected to the drain terminal of the driving transistor 54. The second terminal of the switch transistor 56 is connected to the gate terminal of the driving transistor 54.

The gate terminal of the switch transistor 58 is connected to a second select line SEL2. The first terminal of the switch transistor 58 is connected to a signal line VDATA. The second terminal of the switch transistor 58 is connected to the shared terminal of the storage capacitors 52 and 53 (i.e. node C2). The anode electrode of the OLED 50 is connected to a voltage supply electrode VDD.

The OLED 50 and the transistors 54 and 56 are connected at node A2. The storage capacitor 52 and the transistors 54 and 56 are connected at node B2.

Figure 9:
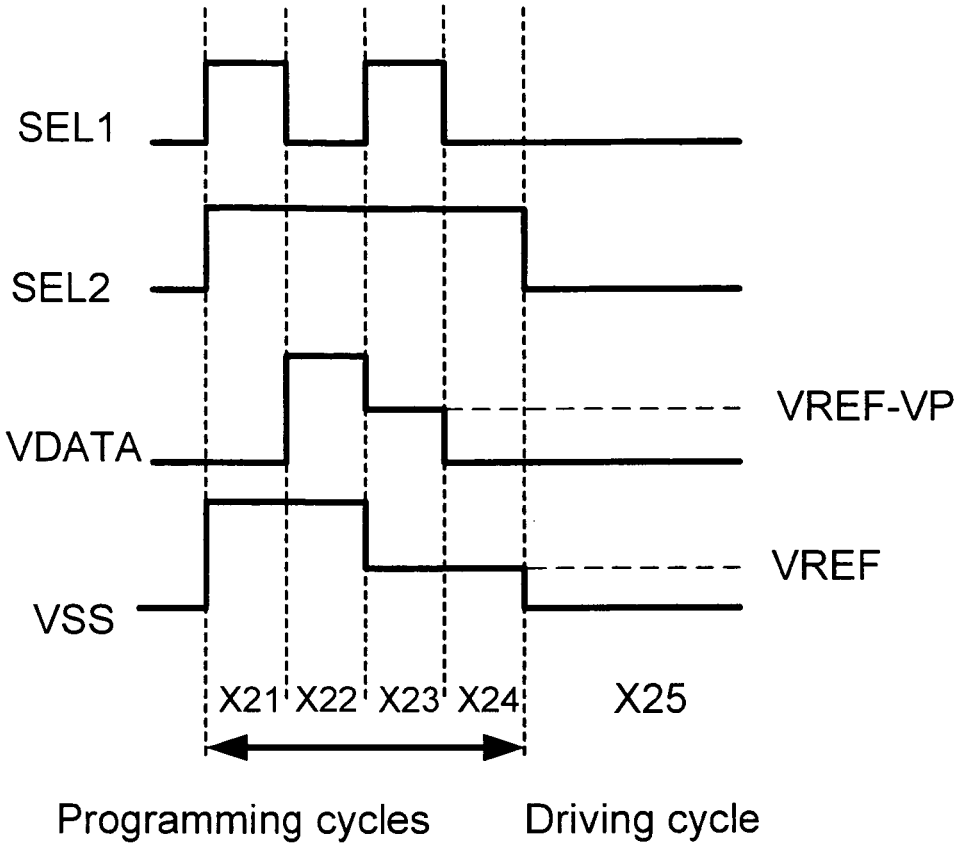
FIG. 9 is a timing diagram showing an example of waveforms for programming and driving the pixel circuit of FIG. 8.

FIG. 9 illustrates a timing diagram showing an example of waveforms for programming and driving the pixel circuit 202 of FIG. 8. Referring to FIGS. 8 and 9, the operation of the pixel circuit 202 includes a programming cycle having four operating cycles X21, X22, X23 and X24, and a driving cycle having one operating cycle X25.

During the programming cycle, a programming voltage plus the threshold voltage of the driving transistor 54 is stored in the storage capacitor 52. The source terminal of the driving transistor 54 goes to zero, and the second storage capacitor 53 is charged to zero.

As a result, the gate-source voltage of the driving transistor 54 goes to:

$$VGS=VP+VT \tag{2}$$

where VGS represents the gate-source voltage of the driving transistor 54, VP represents the programming voltage, and VT represents the threshold voltage of the driving transistor 54.

In the first operating cycle X21: VSS goes to a high positive voltage, and VDATA is zero. SEL1 and SEL2 are high. Therefore, nodes A2 and B2 are charged to a positive voltage.

In the second operating cycle X22: While SEL1 is low and the switch transistor 56 is off, VDATA goes to a high positive voltage. As a result, the voltage at node B2 increases (i.e. bootstrapping) and node A2 is charged to the voltage of VSS. At this voltage, the OLED 50 is off.

In the third operating cycle X23: VSS goes to a reference voltage VREF. VDATA goes to (VREF−VP). At the beginning of this cycle, the voltage of node B2 becomes almost equal to the voltage of node A2 because the capacitance 51 of the OLED 50 is bigger than that of the storage capacitor 52. After that, the voltage of node B2 and the voltage of node A2 are discharged through the driving transistor 54 until the driving transistor 54 turns off. As a result, the gate-source voltage of the driving transistor 54 is (VREF+VT), and the voltage stored in storage capacitor 52 is (VP+VT).

In the fourth operating cycle X24: SEL1 is low. Since SEL2 is high, and VDATA is zero, the voltage at node C2 goes to zero.

In the fifth operating cycle X25: VSS goes to its operating voltage during the driving cycle. In FIG. 5, the operating voltage of VSS is zero. However, it may be any voltage other than zero. SEL2 is low. The voltage stored in the storage capacitor 52 is applied to the gate terminal of the driving transistor 54. Accordingly, a current independent of the threshold voltage VT of the driving transistor 54 and the voltage of the OLED 50 flows through the driving transistor 54 and the OLED 50. Thus, the degradation of the OLED 50 and instability of the driving transistor 54 does not affect the amount of the current flowing through the driving transistor 54 and the OLED 50.

Figure 10:
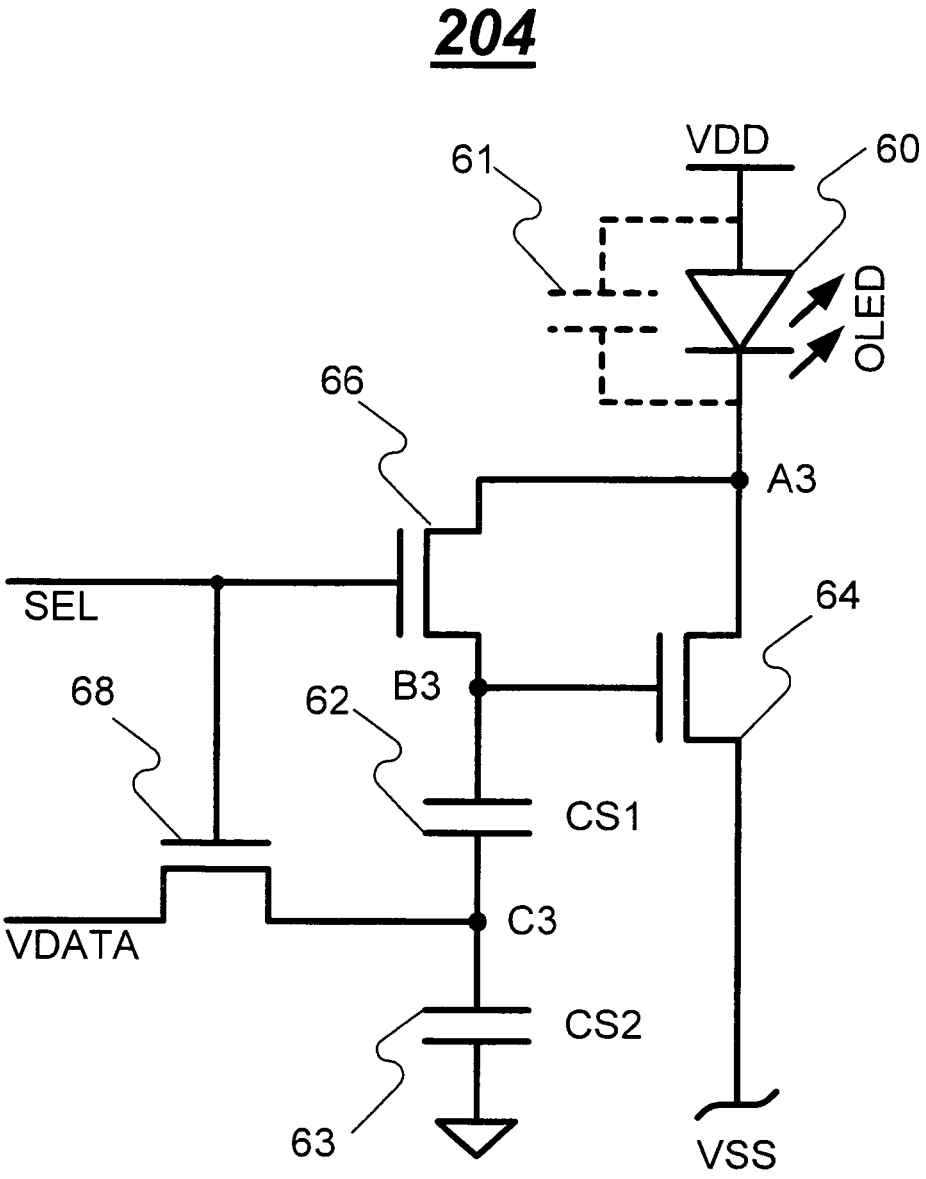
FIG. 10 is a diagram showing a pixel circuit to which programming and driving technique in accordance with a further embodiment of the present invention is applied.

FIG. 10 illustrates a pixel circuit 204 to which programming and driving technique in accordance with a further embodiment of the present invention is applied. The pixel circuit 204 includes an OLED 60, two storage capacitors 62 and 63, a driving transistor 64, and switch transistors 66 and 68. The pixel circuit 204 is a top emission, voltage programmed pixel circuit. The pixel circuit 204 principally works similar to that of in FIG. 8. However, one common select line is used to operate the pixel circuit 204, which can increase the available pixel area and aperture ratio.

Figure 19:
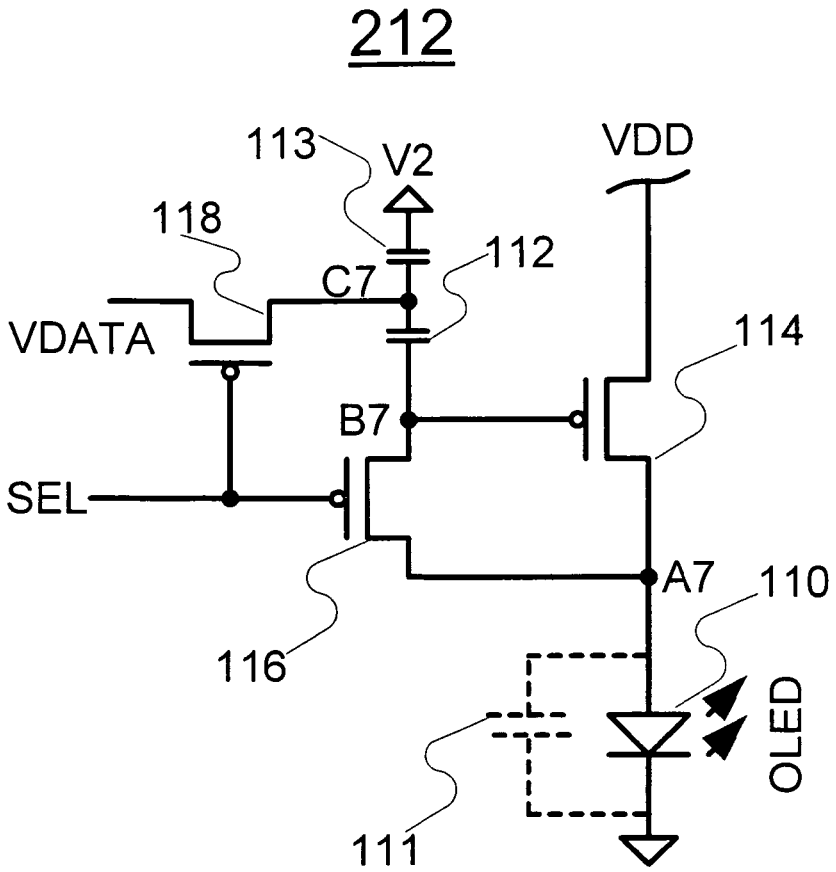
FIG. 19 is a diagram showing a pixel circuit to which programming and driving technique in accordance with a further embodiment of the present invention is applied.

The transistors 64, 66 and 68 are n-type TFTs. However, The transistors 64, 66 and 68 may be p-type transistors. The driving technique applied to the pixel circuit 204 is also applicable to a complementary pixel circuit having p-type transistors as shown in FIG. 19. The transistors 64, 66 and 68 may be fabricated using amorphous silicon, nano/micro crystalline silicon, poly silicon, organic semiconductors technologies (e.g. organic TFT), NMOS/PMOS technology or CMOS technology (e.g. MOSFET).

The first terminal of the driving transistor 64 is connected to the cathode electrode of the OLED 60. The second terminal of the driving transistor 64 is connected to a controllable voltage supply line VSS. The gate terminal of the driving transistor 64 is connected to its first line (terminal) through the switch transistor 66. The storage capacitors 62 and 63 are in series, and are connected between the gate terminal of the driving transistor 64 and the common ground. The voltage of the voltage supply line VSS is controllable. The common ground may be connected to VSS.

The gate terminal of the switch transistor 66 is connected to a select line SEL. The first terminal of the switch transistor 66 is connected to the first terminal of the driving transistor 64. The second terminal of the switch transistor 66 is connected to the gate terminal of the driving transistor 64.

The gate terminal of the switch transistor 68 is connected to the select line SEL. The first terminal of the switch transistor 68 is connected to a signal line VDATA. The second terminal is connected to the shared terminal of storage capacitors 62 and 63 (i.e. node C3). The anode electrode of the OLED 60 is connected to a voltage supply electrode VDD.

The OLED 60 and the transistors 64 and 66 are connected at node A3. The storage capacitor 62 and the transistors 64 and 66 are connected at node B3.

Figure 11:
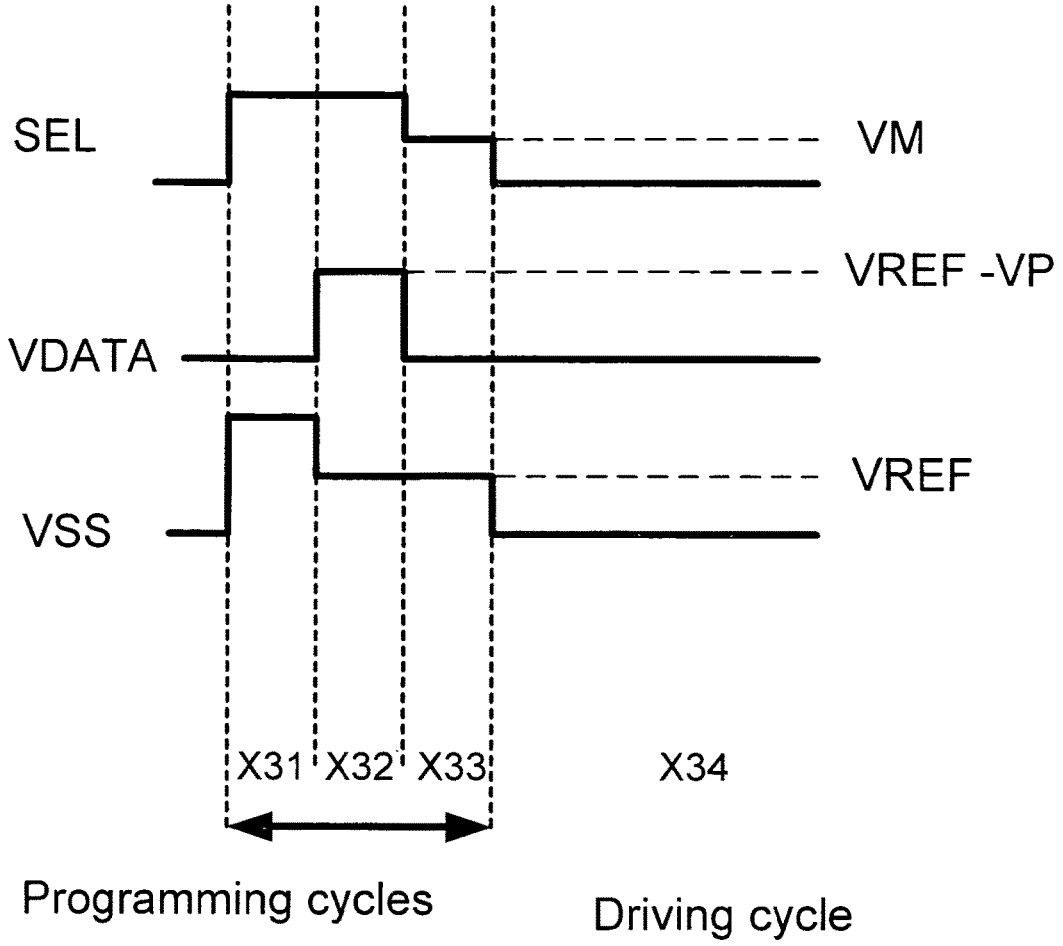
FIG. 11 is a timing diagram showing an example of waveforms for programming and driving the pixel circuit of FIG. 10.

FIG. 11 illustrates a timing diagram showing an example of waveforms for programming and driving the pixel circuit 204 of FIG. 10. Referring to FIGS. 10 and 11, the operation of the pixel circuit 204 includes a programming cycle having three operating cycles X31, X32 and X33, and a driving cycle includes one operating cycle X34.

During the programming cycle, a programming voltage plus the threshold voltage of the driving transistor 64 is stored in the storage capacitor 62. The source terminal of the driving transistor 64 goes to zero and the storage capacitor 63 is charged to zero.

As a result, the gate-source voltage of the driving transistor 64 goes to:

$$VGS=VP+VT \tag{3}$$

where VGS represents the gate-source voltage of the driving transistor 64, VP represents the programming voltage, and VT represents the threshold voltage of the driving transistor 64.

In the first operating cycle X31: VSS goes to a high positive voltage, and VDATA is zero. SEL is high. As a result, nodes A3 and B3 are charged to a positive voltage. The OLED 60 turns off.

In the second operating cycle X32: While SEL is high, VSS goes to a reference voltage VREF. VDATA goes to (VREF−VP). As a result, the voltage at node B3 and the voltage of node A3 are discharged through the driving transistor 64 until the driving transistor 64 turns off. The voltage of node B3 is (VREF+VT), and the voltage stored in the storage capacitor 62 is (VP+VT).

In the third operating cycle X33: SEL goes to VM. VM is an intermediate voltage in which the switch transistor 66 is off and the switch transistor 68 is on. VDATA goes to zero. Since SEL is VM and VDATA is zero, the voltage of node C3 goes to zero.

VM is defined as:

$$VT3 << VM < VREF + VT1 + VT2 \quad (a)$$

where VT1 represents the threshold voltage of the driving transistor 64, VT2 represents the threshold voltage of the switch transistor 66, and VT3 represents the threshold voltage of the switch transistor 68.

The condition (a) forces the switch transistor 66 to be off and the switch transistor 68 to be on. The voltage stored in the storage capacitor 62 remains intact.

In the fourth operating cycle X34: VSS goes to its operating voltage during the driving cycle. In FIG. 11, the operating voltage of VSS is zero. However, the operating voltage of VSS may be any voltage other than zero. SEL is low. The voltage stored in the storage capacitor 62 is applied to the gate of the driving transistor 64. The driving transistor 64 is ON. Accordingly, a current independent of the threshold voltage VT of the driving transistor 64 and the voltage of the OLED 60 flows through the driving transistor 64 and the OLED 60. Thus, the degradation of the OLED 60 and instability of the driving transistor 64 does not affect the amount of the current flowing through the driving transistor 64 and the OLED 60.

Figure 12:
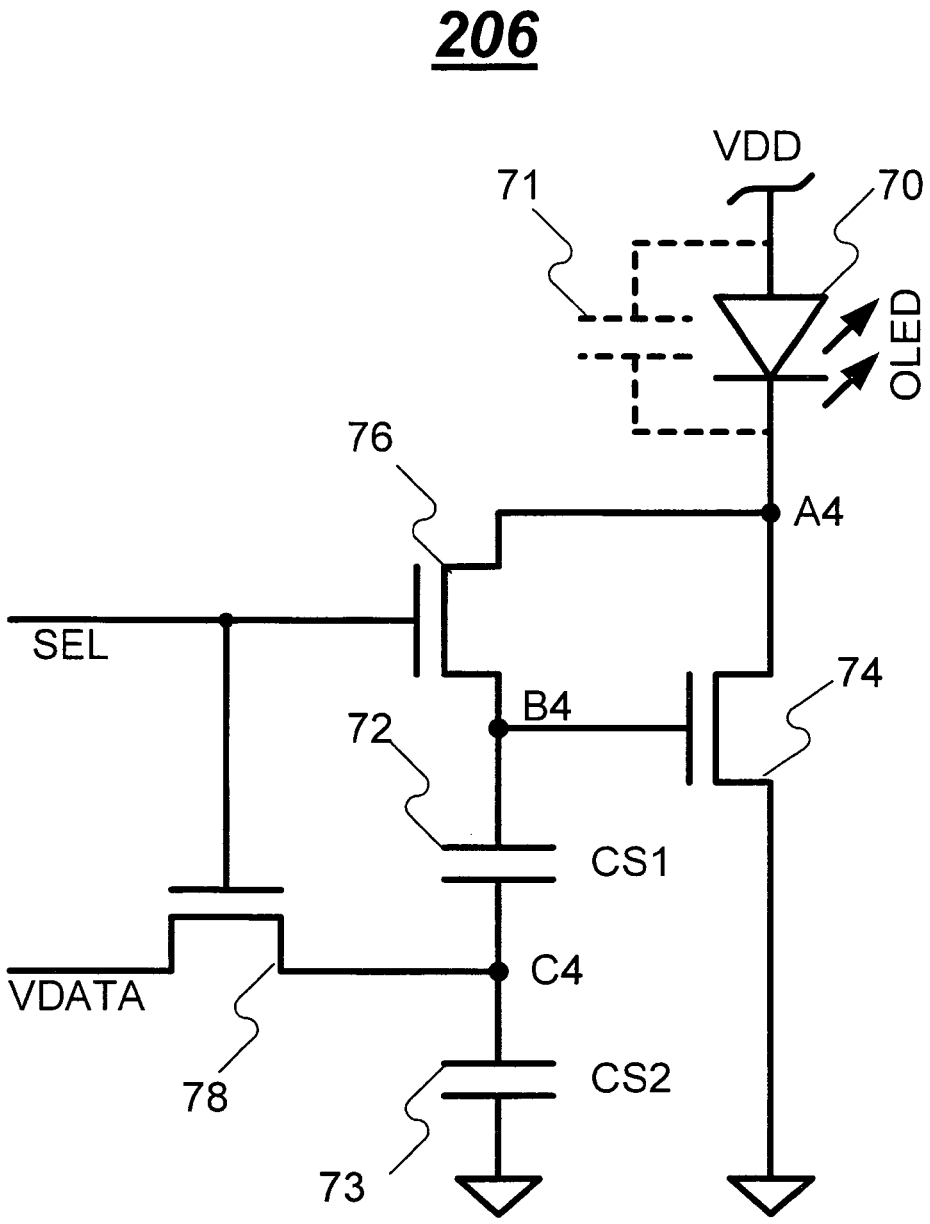
FIG. 12 is a diagram showing a pixel circuit to which programming and driving technique in accordance with a further embodiment of the present invention is applied.

FIG. 12 illustrates a pixel circuit 206 to which programming and driving technique in accordance with a further embodiment of the present invention is applied. The pixel circuit 206 includes an OLED 70, two storage capacitors 72 and 73, a driving transistor 74, and switch transistors 76 and 78. The pixel circuit 206 is a top emission, voltage programmed pixel circuit.

Figure 21:
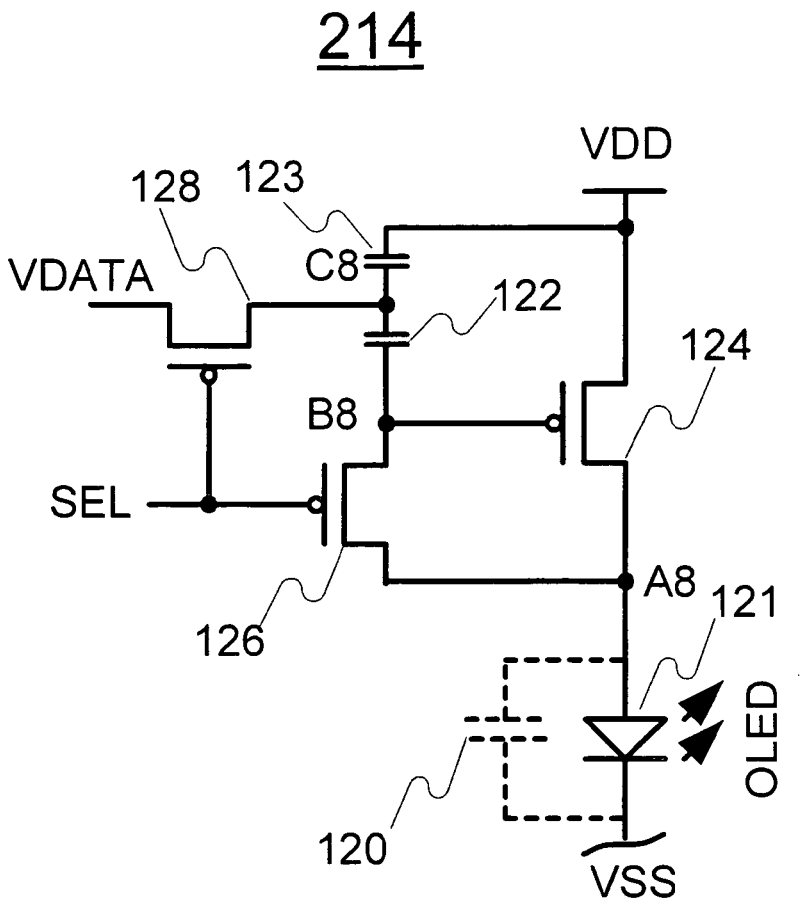
FIG. 21 is a diagram showing a pixel circuit to which programming and driving technique in accordance with a further embodiment of the present invention is applied.

The transistors 74, 76 and 78 are n-type TFTs. However, the transistors 74, 76 and 78 may be p-type transistors. The driving technique applied to the pixel circuit 206 is also applicable to a complementary pixel circuit having p-type transistors as shown in FIG. 21. The transistors 74, 76 and 78 may be fabricated using amorphous silicon, nano/micro crystalline silicon, poly silicon, organic semiconductors technologies (e.g. organic TFT), NMOS/PMOS technology or CMOS technology (e.g. MOSFET).

The first terminal of the driving transistor 74 is connected to the cathode electrode of the OLED 70. The second terminal of the driving transistor 74 is connected to a common ground. The gate terminal of the driving transistor 74 is connected to its first line (terminal) through the switch transistor 76. The storage capacitors 72 and 73 are in series, and are connected between the gate terminal of the driving transistor 74 and the common ground.

The gate terminal of the switch transistor 76 is connected to a select line SEL. The first terminal of the switch transistor 76 is connected to the first terminal of the driving transistor 74. The second terminal of the switch transistor 76 is connected to the gate terminal of the driving transistor 74.

The gate terminal of the switch transistor 78 is connected to the select line SEL. The first terminal of the switch transistor 78 is connected to a signal line VDATA. The second terminal is connected to the shared terminal of storage capacitors 72 and 73 (i.e. node C4). The anode electrode of the OLED 70 is connected to a voltage supply electrode VDD. The voltage of the voltage electrode VDD is controllable.

The OLED 70 and the transistors 74 and 76 are connected at node A4. The storage capacitor 72 and the transistors 74 and 76 are connected at node B4.

Figure 13:
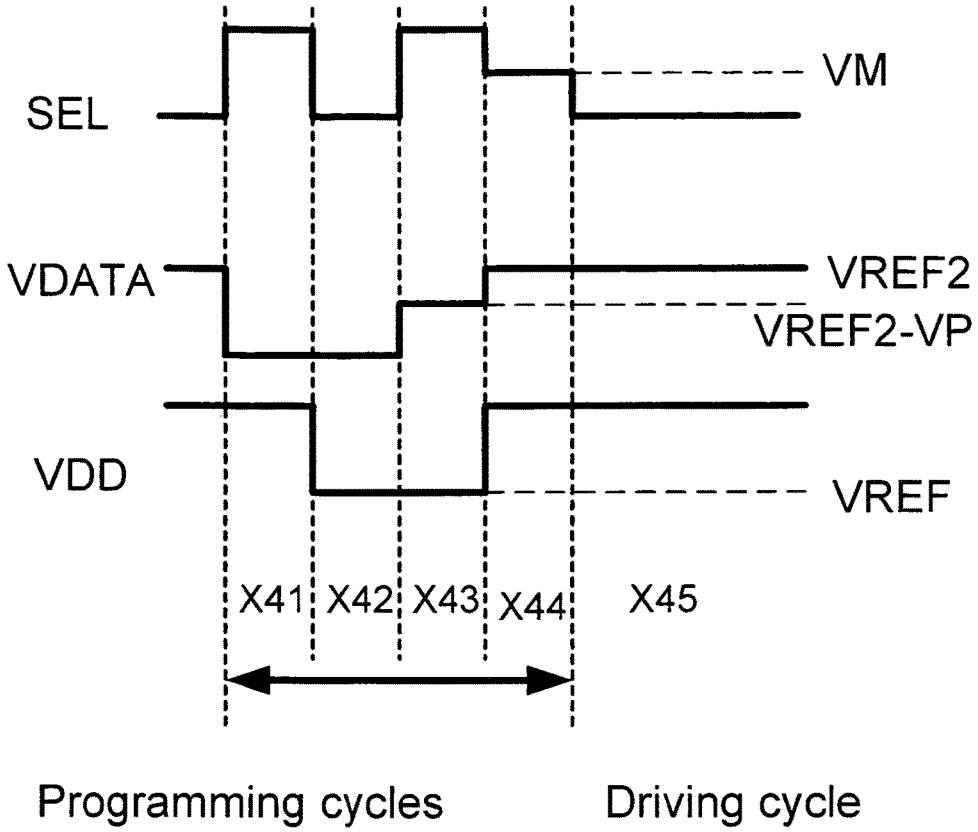
FIG. 13 is a timing diagram showing an example of waveforms for programming and driving the pixel circuit of FIG. 12.

FIG. 13 illustrates a timing diagram showing an example of waveforms for programming and driving the pixel circuit 206 of FIG. 12. Referring to FIGS. 12 and 13, the operation of the pixel circuit 206 includes a programming cycle having four operating cycles X41, X42, X43 and X44, and a driving cycle having one driving cycle 45.

During the programming cycle, a programming voltage plus the threshold voltage of the driving transistor 74 is stored in the storage capacitor 72. The source terminal of the driving transistor 74 goes to zero and the storage capacitor 73 is charged to zero.

As a result, the gate-source voltage of the driving transistor 74 goes to:

$$VGS = VP + VT \quad (4)$$

where VGS represents the gate-source voltage of the driving transistor 74, VP represents the programming voltage, and VT represents the threshold voltage of the driving transistor 74.

In the first operating cycle X41: SEL is high. VDATA goes to a low voltage. While VDD is high, node B4 and node A4 are charged to a positive voltage.

In the second operating cycle X42: SEL is low, and VDD goes to a reference voltage VREF where the OLED 70 is off.

In the third operating cycle X43: VDATA goes to (VREF2−VP) where VREF2 is a reference voltage. It is assumed that VREF2 is zero. However, VREF2 can be any voltage other than zero. SEL is high. Therefore, the voltage of node B4 and the voltage of node A4 become equal at the beginning of this cycle. It is noted that the first storage capacitor 72 is large enough so that its voltage becomes dominant. After that, node B4 is discharged through the driving transistor 74 until the driving transistor 74 turns off.

As a result, the voltage of node B4 is VT (i.e. the threshold voltage of the driving transistor 74). The voltage stored in the first storage capacitor 72 is (VP−VREF2+VT)=(VP+VT) where VREF2=0.

In the fourth operating cycle X44: SEL goes to VM where VM is an intermediate voltage at which the switch transistor 76 is off and the switch transistor 78 is on. VM satisfies the following condition:

$$VT3 << VM < VP + VT \quad (b)$$

where VT3 represents the threshold voltage of the switch transistor 78.

VDATA goes to VREF2 (=0). The voltage of node C4 goes to VREF2 (=0).

This results in that the gate-source voltage VGS of the driving transistor 74 is (VP+VT). Since VM<VP+VT, the switch transistor 76 is off, and the voltage stored in the storage capacitor 72 stays at VP+VT.

In the fifth operating cycle X45: VDD goes to the operating voltage. SEL is low. The voltage stored in the storage capacitor 72 is applied to the gate of the driving transistor 74. Accordingly, a current independent of the threshold voltage VT of the driving transistor 74 and the voltage of the OLED 70 flows through the driving transistor 74 and the OLED 70. Thus, the degradation of the OLED 70 and instability of the driving transistor 74 does not affect the amount of the current flowing through the driving transistor 74 and the OLED 70.

FIG. 14 illustrates a pixel circuit 208 to which programming and driving technique in accordance with a further embodiment of the present invention is applied. The pixel circuit 208 includes an OLED 80, a storage capacitor 81, a driving transistor 84 and a switch transistor 86. The pixel circuit 208 corresponds to the pixel circuit 200 of FIG. 3, and a voltage programmed pixel circuit.

The transistors 84 and 86 are p-type TFTs. The transistors 84 and 86 may be fabricated using amorphous silicon, nano/micro crystalline silicon, poly silicon, organic semiconductors technologies (e.g. organic TFT), CMOS technology (e.g. MOSFET) and any other technology which provides p-type transistors.

The first terminal of the driving transistor 84 is connected to a controllable voltage supply line VSS. The second terminal of the driving transistor 84 is connected to the cathode electrode of the OLED 80. The gate terminal of the driving transistor 84 is connected to a signal line VDATA through the switch transistor 86. The storage capacitor 81 is connected between the second terminal and the gate terminal of the driving transistor 84.

The gate terminal of the switch transistor 86 is connected to a select line SEL. The first terminal of the switch transistor 86 is connected to the signal line VDATA. The second terminal of the switch transistor 86 is connected to the gate terminal of the driving transistor 84. The anode electrode of the OLED 80 is connected to a ground voltage supply electrode.

The storage capacitor 81 and the transistors 84 and 85 are connected at node A5. The OLED 80, the storage capacitor 81 and the driving transistor 84 are connected at node B5.

Figure 15:
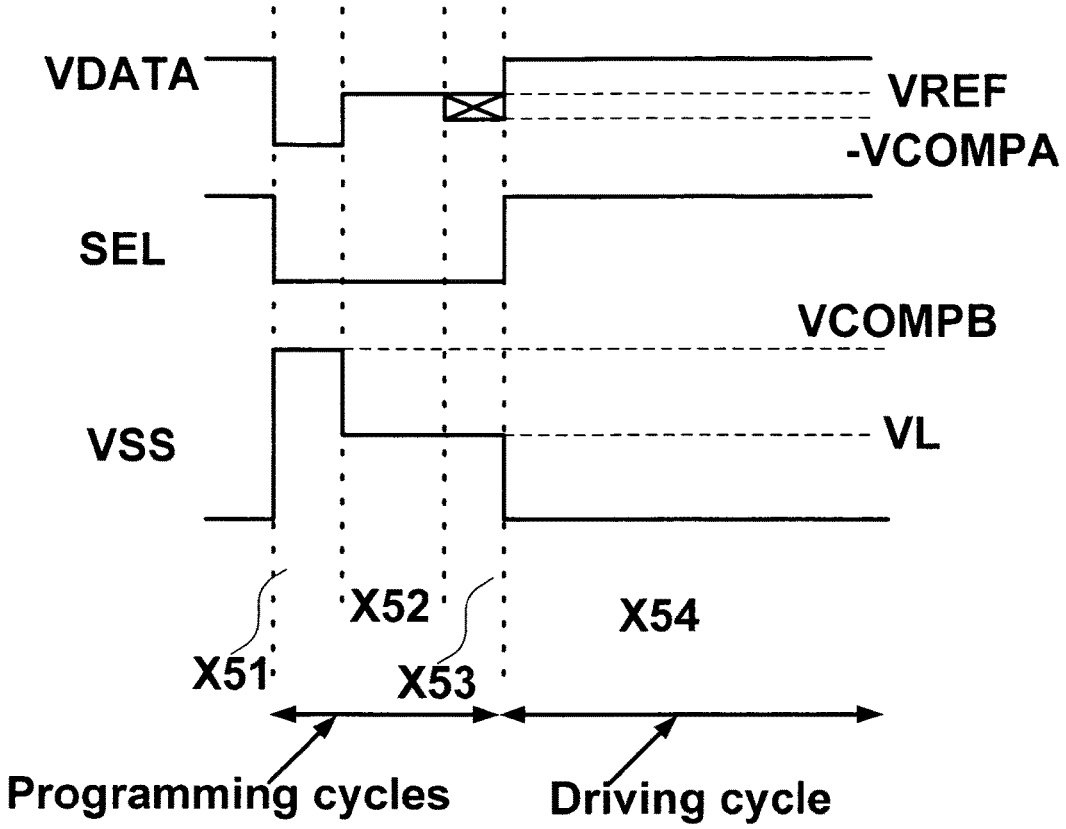
FIG. 15 is a timing diagram showing an example of waveforms for programming and driving the pixel circuit of FIG. 14.

FIG. 15 illustrates a timing diagram showing an example of waveforms for programming and driving the pixel circuit 208 of Figure. FIG. 15 corresponds to FIG. 4. VDATA and VSS are used to programming and compensating for a time dependent parameter of the pixel circuit 208, which are similar to VDATA and VDD of FIG. 4. Referring to FIGS. 14 and 15, the operation of the pixel circuit 208 includes a programming cycle having three operating cycles X51, X52 and X53, and a driving cycle having one operating cycle X54.

During the programming cycle, node B5 is charged to a positive threshold voltage of the driving transistor 84, and node A5 is charged to a negative programming voltage.

As a result, the gate-source voltage of the driving transistor 84 goes to:

$$VGS=-VP+(-|VT|)=-VP-|VT| \quad (5)$$

where VGS represents the gate-source voltage of the driving transistor 84, VP represents the programming voltage, and VT represents the threshold voltage of the driving transistor 84.

In the first operating cycle X51: VSS goes to a positive compensating voltage VCOMPB, and VDATA goes to a negative compensating voltage (−VCOMPA), and SEL is low. As a result, the switch transistor 86 is on. Node A5 is charged to (−VCOMPA). Node B5 is charged to VCOMPB.

In the second operating cycle X52: VDATA goes to a reference voltage VREF. Node B5 is discharged through the driving transistor 84 until the driving transistor 84 turns off. As a result, the voltage of node B5 reaches VREF+|VT|. VSS goes to a negative voltage VL to increase the speed of this cycle X52. For the optimal setting time, VL is selected to be equal to the operating voltage which is the voltage of VSS during the driving cycle.

In the third operating cycle X53: While VSS is in the VL level, and SEL is low, node A5 is charged to (VREF−VP). Because the capacitance 82 of the OLED 80 is large, the voltage of node B5 stays at the positive threshold voltage of the driving transistor 84. Therefore, the gate-source voltage of the driving transistor 84 is (−VP−VT|), which is stored in storage capacitor 81.

In the fourth operating cycle X54: SEL and VDATA go to zero. VSS goes to a high negative voltage (i.e. its operating voltage). The voltage stored in the storage capacitor 81 is applied to the gate terminal of the driving transistor 84. Accordingly, a current independent of the voltage of the OLED 80 and the threshold voltage of the driving transistor 84 flows through the driving transistor 84 and the OLED 80. Thus, the degradation of the OLED 80 and instability of the driving transistor 84 does not affect the amount of the current flowing through the driving transistor 84 and the OLED 80.

It is noted that the pixel circuit 208 can be operated with different values of VCOMPB, VCOMPA, VL, VREF and VP. VCOMPB, VCOMPA, VL, VREF and VP define the lifetime of the pixel circuit. Thus, these voltages can be defined in accordance with the pixel specifications.

Figure 16:
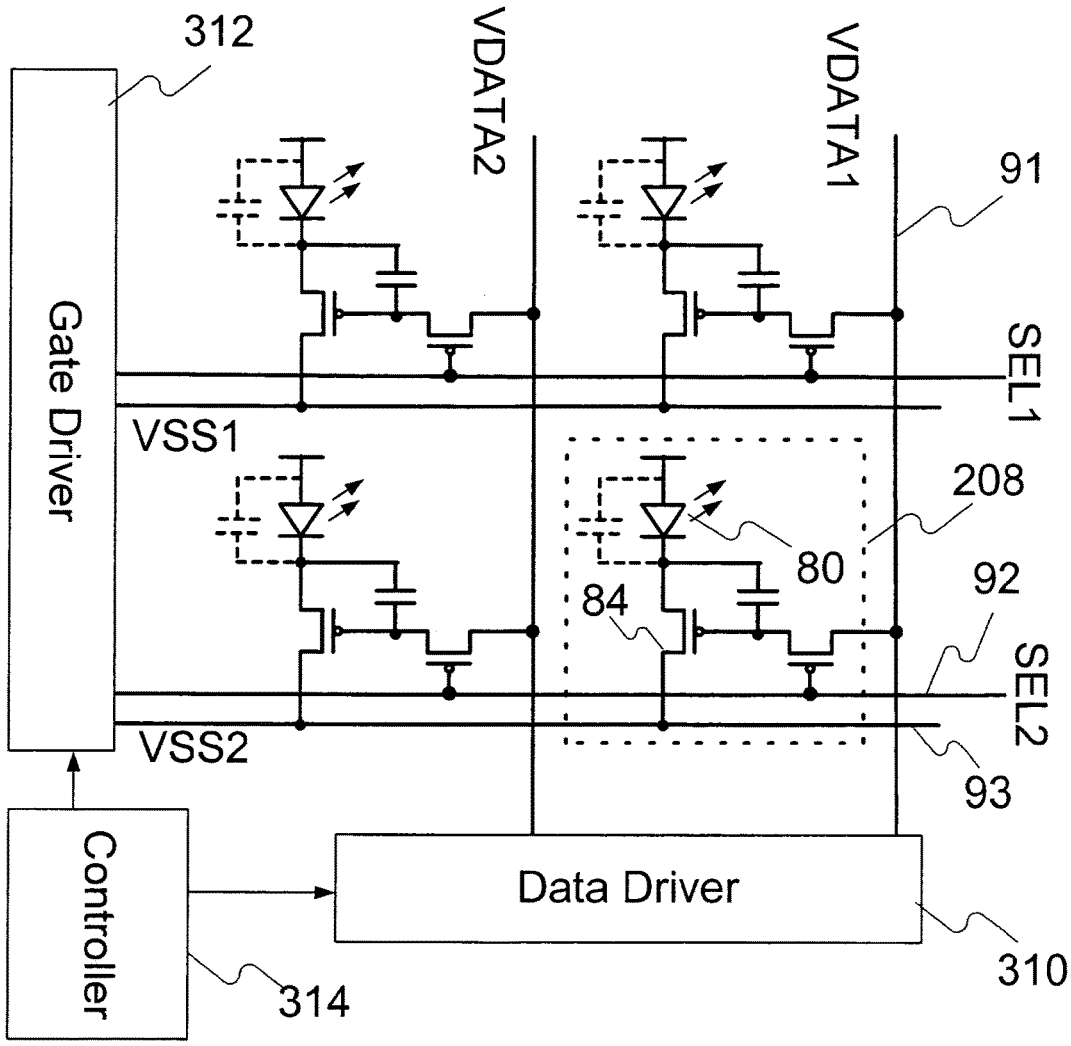
FIG. 16 is a diagram showing a display system having the pixel circuit of FIG. 14.

FIG. 16 illustrates a display system having the pixel circuit 208 of FIG. 14. VSS1 and VSS2 of FIG. 16 correspond to VSS of FIG. 14. SEL1 and SEL2 of FIG. 16 correspond to SEL of FIG. 14. VDATA1 and VDATA2 of FIG. 16 correspond to VDATA of FIG. 14. The array of FIG. 16 is an active matrix light emitting diode (AMOLED) display having a plurality of the pixel circuits 208 of FIG. 14. The pixel circuits 208 are arranged in rows and columns, and interconnections 91, 92 and 93 (VDATA1, SEL2, VSS2). VDATA1 (or VDATA2) is shared between the common column pixels while SEL1 (or SEL2) and VSS1 (or VSS2) are shared between common row pixels in the array structure.

A driver 310 is provided for driving VDATA1 and VDATA2. A driver 312 is provided for driving VSS1, VSS2, SEL1 and SEL2. A controller 314 controls the drivers 310 and 312 to implement the programming and driving cycles described above. The timing diagram for programming and driving the display array of FIG. 6 is as shown in FIG. 2. Each programming and driving cycle may be the same as that of FIG. 15.

The array of FIG. 16 may have array structure shown in FIG. 7(*a*) or 7(*b*). The array of FIG. 16, is produced in a manner similar to that of FIG. 6. All of the pixel circuits including the TFTs, the storage capacitor, the SEL, VDATA, and VSS lines are fabricated together. After that, the OLEDs are fabricated for all pixel circuits. The OLED is connected to the corresponding driving transistor using a via (e.g. B5 of FIG. 14). The panel is finished by deposition of the top electrode on the OLEDs which can be a continuous layer, reducing the complexity of the design and can be used to turn the entire display ON/OFF or control the brightness.

FIG. 17 illustrates a pixel circuit 210 to which programming and driving technique in accordance with a further embodiment of the present invention is applied. The pixel circuit 210 includes an OLED 100, two storage capacitors 102 and 103, a driving transistor 104, and switch transistors 106 and 108. The pixel circuit 210 corresponds to the pixel circuit 202 of FIG. 8.

The transistors 104, 106 and 108 are p-type TFTs. The transistors 84 and 86 may be fabricated using amorphous silicon, nano/micro crystalline silicon, poly silicon, organic semiconductors technologies (e.g. organic TFT), CMOS technology (e.g. MOSFET) and any other technology which provides p-type transistors.

In FIG. 17, one of the terminals of the driving transistor 104 is connected to the anode electrode of the OLED 100, while the other terminal is connected to a controllable voltage supply line VDD. The storage capacitors 102 and 103 are in series, and are connected between the gate terminal of the driving transistor 104 and a voltage supply electrode V2. Also, V2 may be connected to VDD. The cathode electrode of the OLED 100 is connected to a ground voltage supply electrode.

The OLED 100 and the transistors 104 and 106 are connected at node A6. The storage capacitor 102 and the transistors 104 and 106 are connected at node B6. The transistor 108 and the storage capacitors 102 and 103 are connected at node C6.

Figure 18:
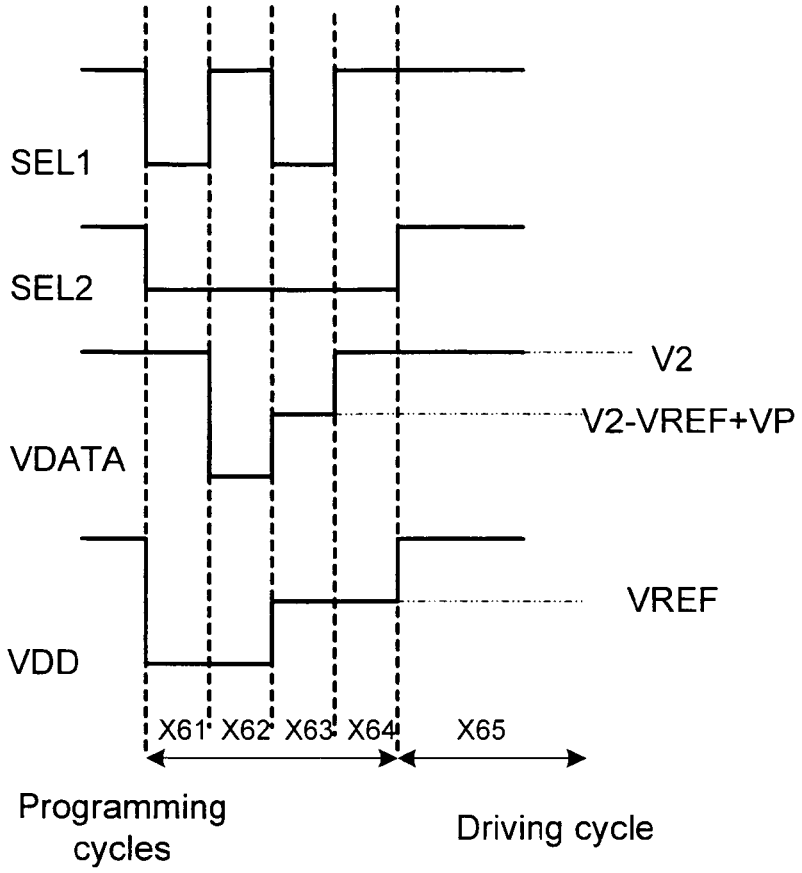
FIG. 18 is a timing diagram showing an example of waveforms for programming and driving the pixel circuit of FIG. 17.

FIG. 18 illustrates a timing diagram showing an example of waveforms for programming and driving the pixel circuit 210 of FIG. 17. FIG. 18 corresponds to FIG. 9. VDATA and VDD are used to programming and compensating for a time dependent parameter of the pixel circuit 210, which are similar to VDATA and VSS of FIG. 9. Referring to FIGS. 17 and 18, the operation of the pixel circuit 210 includes a programming cycle having four operating cycles X61, X62, X63 and X64, and a driving cycle having one operating cycle X65.

During the programming cycle, a negative programming voltage plus the negative threshold voltage of the driving transistor 104 is stored in the storage capacitor 102, and the second storage capacitor 103 is discharged to zero.

As a result, the gate-source voltage of the driving transistor 104 goes to:

$$VGS=-VP-|VT| \tag{6}$$

where VGS represents the gate-source voltage of the driving transistor 104, VP represents the programming voltage, and VT represents the threshold voltage of the driving transistor 104.

In the first operating cycle X61: VDD goes to a high negative voltage, and VDATA is set to V2. SEL1 and SEL2 are low. Therefore, nodes A6 and B6 are charged to a negative voltage.

In the second operating cycle X62: While SEL1 is high and the switch transistor 106 is off, VDATA goes to a negative voltage. As a result, the voltage at node B6 decreases, and the voltage of node A6 is charged to the voltage of VDD. At this voltage, the OLED 100 is off.

In the third operating cycle X63: VDD goes to a reference voltage VREF. VDATA goes to (V2−VREF+VP) where VREF is a reference voltage. It is assumed that VREF is zero. However, VREF may be any voltage other than zero. At the beginning of this cycle, the voltage of node B6 becomes almost equal to the voltage of node A6 because the capacitance 101 of the OLED 100 is bigger than that of the storage capacitor 102. After that, the voltage of node B6 and the voltage of node A6 are charged through the driving transistor 104 until the driving transistor 104 turns off. As a result, the gate-source voltage of the driving transistor 104 is (−VP−|VT|), which is stored in the storage capacitor 102.

In the fourth operating cycle X64: SEL1 is high. Since SEL2 is low, and VDATA goes to V2, the voltage at node C6 goes to V2.

In the fifth operating cycle X65: VDD goes to its operating voltage during the driving cycle. In FIG. 18, the operating voltage of VDD is zero. However, the operating voltage of VDD may be any voltage. SEL2 is high. The voltage stored in the storage capacitor 102 is applied to the gate terminal of the driving transistor 104. Thus, a current independent of the threshold voltage VT of the driving transistor 104 and the voltage of the OLED 100 flows through the driving transistor 104 and the OLED 100. Accordingly, the degradation of the OLED 100 and instability of the driving transistor 104 do not affect the amount of the current flowing through the driving transistor 54 and the OLED 100.

FIG. 19 illustrates a pixel circuit 212 to which programming and driving technique in accordance with a further embodiment of the present invention is applied. The pixel circuit 212 includes an OLED 110, two storage capacitors 112 and 113, a driving transistor 114, and switch transistors 116 and 118. The pixel circuit 212 corresponds to the pixel circuit 204 of FIG. 10.

The transistors 114, 116 and 118 are p-type TFTs. The transistors 84 and 86 may be fabricated using amorphous silicon, nano/micro crystalline silicon, poly silicon, organic semiconductors technologies (e.g. organic TFT), CMOS technology (e.g. MOSFET) and any other technology which provides p-type transistors.

In FIG. 19, one of the terminals of the driving transistor 114 is connected to the anode electrode of the OLED 110, while the other terminal is connected to a controllable voltage supply line VDD. The storage capacitors 112 and 113 are in series, and are connected between the gate terminal of the driving transistor 114 and a voltage supply electrode V2. Also, V2 may be connected to VDD. The cathode electrode of the OLED 100 is connected to a ground voltage supply electrode.

The OLED 110 and the transistors 114 and 116 are connected at node A7. The storage capacitor 112 and the transistors 114 and 116 are connected at node B7. The transistor 118 and the storage capacitors 112 and 113 are connected at node C7.

Figure 20:
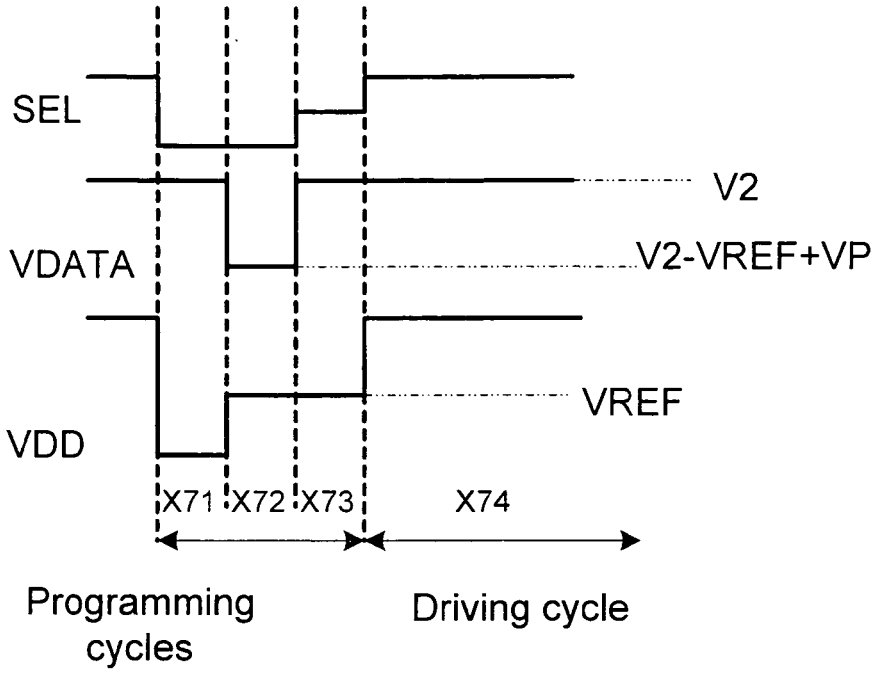
FIG. 20 is a timing diagram showing an example of waveforms for programming and driving the pixel circuit of FIG. 19.

FIG. 20 illustrates a timing diagram showing an example of waveforms for programming and driving the pixel circuit 212 of FIG. 19. FIG. 20 corresponds to FIG. 11. VDATA and VDD are used to programming and compensating for a time dependent parameter of the pixel circuit 212, which are similar to VDATA and VSS of FIG. 11. Referring to FIGS. 19 and 20, the operation of the pixel circuit 212 includes a programming cycle having four operating cycles X71, X72 and X73, and a driving cycle having one operating cycle X74.

During the programming cycle, a negative programming voltage plus the negative threshold voltage of the driving transistor 114 is stored in the storage capacitor 112. The storage capacitor 113 is discharged to zero.

As a result, the gate-source voltage of the driving transistor 114 goes to:

$$VGS=-VP-|VT| \tag{7}$$

where VGS represents the gate-source voltage of the driving transistor 114, VP represents the programming voltage, and VT represents the threshold voltage of the driving transistor 114.

In the first operating cycle X71: VDD goes to a negative voltage. SEL is low. Node A7 and node B7 are charged to a negative voltage.

In the second operating cycle X72: VDD goes to a reference voltage VREF. VDATA goes to (V2−VREF+VP). The voltage at node B7 and the voltage of node A7 are changed until the driving transistor 114 turns off. The voltage of B7 is (−VREF−VT), and the voltage stored in the storage capacitor 112 is (−VP−|VT|).

In the third operating cycle X73: SEL goes to VM. VM is an intermediate voltage in which the switch transistor 106 is off and the switch transistor 118 is on. VDATA goes to V2. The voltage of node C7 goes to V2. The voltage stored in the storage capacitor 112 is the same as that of X72.

In the fourth operating cycle X74: VDD goes to its operating voltage. SEL is high. The voltage stored in the storage capacitor 112 is applied to the gate of the driving transistor 114. The driving transistor 114 is on. Accordingly, a current independent of the threshold voltage VT of the driving transistor 114 and the voltage of the OLED 110 flows through the driving transistor 114 and the OLED 110.

FIG. 21 illustrates a pixel circuit 214 to which programming and driving technique in accordance with a further embodiment of the present invention is applied. The pixel circuit 214 includes an OLED 120, two storage capacitors 122 and 123, a driving transistor 124, and switch transistors 126 and 128. The pixel circuit 212 corresponds to the pixel circuit 206 of FIG. 12.

The transistors 124, 126 and 128 are p-type TFTs. The transistors 84 and 86 may be fabricated using amorphous silicon, nano/micro crystalline silicon, poly silicon, organic semiconductors technologies (e.g. organic TFT), CMOS technology (e.g. MOSFET) and any other technology which provides p-type transistors.

In FIG. 21, one of the terminals of the driving transistor 124 is connected to the anode electrode of the OLED 120, while the other terminal is connected to a voltage supply line VDD. The storage capacitors 122 and 123 are in series, and are connected between the gate terminal of the driving transistor 124 and VDD. The cathode electrode of the OLED 120 is connected to a controllable voltage supply electrode VSS.

The OLED 120 and the transistors 124 and 126 are connected at node A8. The storage capacitor 122 and the transistors 124 and 126 are connected at node B8. The transistor 128 and the storage capacitors 122 and 123 are connected at node C8.

Figure 22:
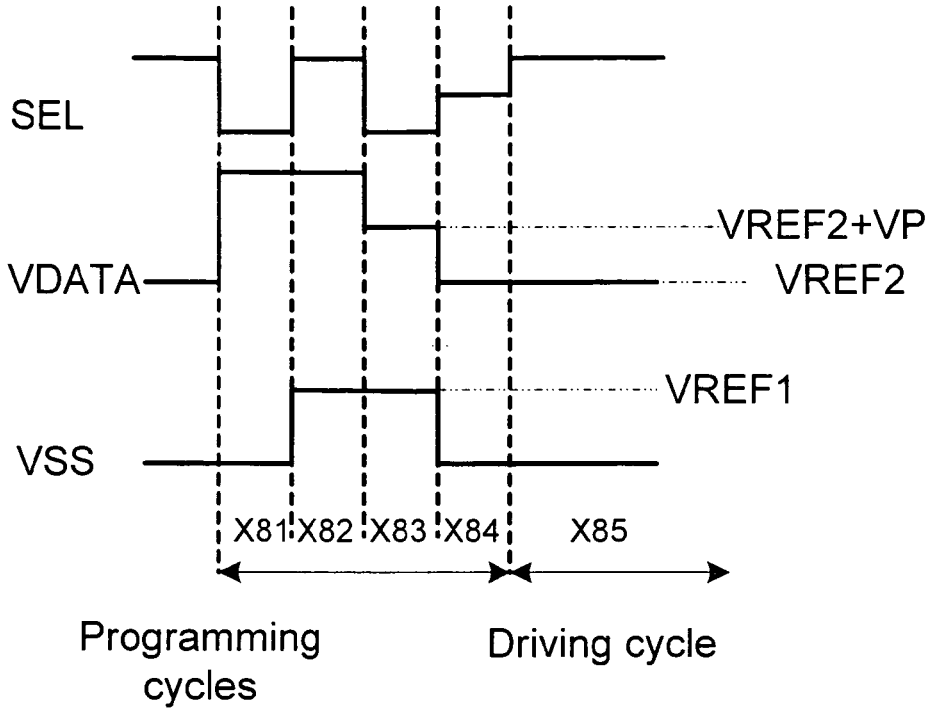
FIG. 22 is a timing diagram showing an example of waveforms for programming and driving the pixel circuit of FIG. 21.

FIG. 22 illustrates a timing diagram showing an example of waveforms for programming and driving the pixel circuit 214 of FIG. 21. FIG. 22 corresponds to FIG. 13. VDATA and VSS are used to programming and compensating for a time dependent parameter of the pixel circuit 214, which are similar to VDATA and VDD of FIG. 13. Referring to FIGS. 21 and 22, the programming of the pixel circuit 214 includes a programming cycle having four operating cycles X81, X82, X83 and X84, and a driving cycle having one driving cycle X85.

During the programming cycle, a negative programming voltage plus the negative threshold voltage of the driving transistor 124 is stored in the storage capacitor 122. The storage capacitor 123 is discharged to zero.

As a result, the gate-source voltage of the driving transistor 124 goes to:

$$VGS=-VP-|VT| \tag{8}$$

where VGS represents the gate-source voltage of the driving transistor 114, VP represents the programming voltage, and VT represents the threshold voltage of the driving transistor 124.

In the first operating cycle X81: VDATA goes to a high voltage. SEL is low. Node A8 and node B8 are charged to a positive voltage.

In the second operating cycle X82: SEL is high. VSS goes to a reference voltage VREF1 where the OLED 60 is off.

In the third operating cycle X83: VDATA goes to (VREF2+VP) where VREF2 is a reference voltage. SEL is low. Therefore, the voltage of node B8 and the voltage of node A8 become equal at the beginning of this cycle. It is noted that the first storage capacitor 112 is large enough so that its voltage becomes dominant. After that, node B8 is charged through the driving transistor 124 until the driving transistor 124 turns off. As a result, the voltage of node B8 is (VDD−|VT|). The voltage stored in the first storage capacitor 122 is (−VREF2−VP−|VT|).

In the fourth operating cycle X84: SEL goes to VM where VM is an intermediate voltage at which the switch transistor 126 is off and the switch transistor 128 is on. VDATA goes to VREF2. The voltage of node C8 goes to VREF2.

This results in that the gate-source voltage VGS of the driving transistor 124 is (−VP−|VT|). Since VM<−VP−VT, the switch transistor 126 is off, and the voltage stored in the storage capacitor 122 stays at −(VP+|VT|).

In the fifth operating cycle X85: VSS goes to the operating voltage. SEL is low. The voltage stored in the storage capacitor 122 is applied to the gate of the driving transistor 124.

It is noted that a system for operating an array having the pixel circuit of FIG. 8, 10, 12, 17, 19 or 21 may be similar to that of FIG. 6 or 16. The array having the pixel circuit of FIG. 8, 10, 12, 17, 19 or 21 may have array structure shown in FIG. 7(*a*) or 7(*b*).

It is noted that each transistor can be replaced with p-type or n-type transistor based on concept of complementary circuits.

According to the embodiments of the present invention, the driving transistor is in saturation regime of operation. Thus, its current is defined mainly by its gate-source voltage VGS. As a result, the current of the driving transistor remains constant even if the OLED voltage changes since its gate-source voltage is stored in the storage capacitor.

According to the embodiments of the present invention, the overdrive voltage providing to a driving transistor is generated by applying a waveform independent of the threshold voltage of the driving transistor and/or the voltage of a light emitting diode voltage.

According to the embodiments of the present invention, a stable driving technique based on bootstrapping is provided (e.g. FIGS. 2-12 and 16-20).

The shift(s) of the characteristic(s) of a pixel element(s) (e.g. the threshold voltage shift of a driving transistor and the degradation of a light emitting device under prolonged display operation) is compensated for by voltage stored in a storage capacitor and applying it to the gate of the driving transistor. Thus, the pixel circuit can provide a stable current though the light emitting device without any effect of the shifts, which improves the display operating lifetime. Moreover, because of the circuit simplicity, it ensures higher product yield, lower fabrication cost and higher resolution than conventional pixel circuits.

All citations are hereby incorporated by reference.

The present invention has been described with regard to one or more embodiments. However, it will be apparent to persons skilled in the art that a number of variations and modifications can be made without departing from the scope of the invention as defined in the claims.

What is claimed is:

1. A method of programming a pixel circuit that drives a current-driven organic light emitting device independent of a threshold voltage of a drive transistor connected in series to the organic light emitting device, the pixel circuit further including a first switch transistor connected between the organic light emitting device and a node of the pixel circuit, the method comprising:

adjusting during a programming cycle a controllable voltage supply to a compensation voltage;

in a first operating cycle of the programming cycle, selecting a select line, to turn on a second switch transistor coupled to the drive transistor, for applying a reference voltage to the drive transistor through the second switch transistor, and to turn on the first switch transistor, and applying to a data line connected to the second switch transistor a voltage that exceeds a programming voltage to be applied to the drive transistor;

responsive to the adjusting, allowing the node of the pixel circuit to charge or discharge through the drive transistor, via the first switch transistor, until the drive transistor turns off, thereby establishing the threshold voltage of the drive transistor across the drive transistor;

in a further operating cycle of the programming cycle following the first operating cycle, selecting the select line to turn on the second switch transistor for applying a programming voltage from the data line to the drive transistor through the second switch transistor, thereby establishing a fixed voltage applied to the drive transistor according to both the threshold voltage and the applied programming voltage, wherein the programming voltage is lower than the reference voltage;

responsive to the applying the programming voltage, selecting the select line with an intermediate selection voltage being sufficient to turn on the second switch transistor while turning off the first switch transistor; and applying a second reference voltage, via the data line, to allow the fixed voltage in the pixel circuit to be independent of the reference voltage.

2. The method of claim 1, further comprising:

setting the controllable voltage supply to an operating voltage; and deselecting the select line to complete the programming cycle and initiate a drive cycle during which the light emitting device is turned on according to the programming voltage while maintaining the fixed voltage on the drive transistor.

3. The method of claim 2, wherein the compensation voltage is sufficient to prevent the organic light emitting device from being turned on prior to the initiation of the drive cycle.

4. The method of claim 1, wherein the pixel circuit includes a storage capacitor coupled to the gate terminal of the drive transistor, and wherein the node of the pixel circuit is coupled to the gate terminal of the transistor such that the allowing the node of the pixel circuit to discharge is carried out by charging the storage capacitor through the first switch transistor and the drive transistor.

5. The method of claim 1, wherein a voltage stored on the node following the drive transistor turning off is different from the voltage on a voltage supply line connected to a terminal of the drive transistor opposite the organic light emitting device by the threshold voltage of the drive transistor.

6. The method of claim 1, wherein the select line remains selected during the allowing the node to charge or discharge and the applying the programming voltage.

7. The method of claim 1, wherein the pixel circuit includes a storage capacitor coupled between the second switch transistor and the node of the pixel circuit for being charged with the fixed voltage, and a first capacitor coupled between a voltage supply line connected to the drive transistor opposite the light emitting device and the storage capacitor, the second switch transistor connected to a node between the first capacitor and the storage capacitor, and wherein the applying the second reference voltage discharges the first capacitor and leaves the fixed voltage on the storage capacitor.

8. A display system comprising:

a pixel circuit including a drive transistor, a light emitting device, a first switch transistor, and a second switch transistor, the drive transistor having a first terminal connected to the light-emitting device, the drive transistor having a threshold voltage that shifts during operation of the drive transistor, the first switch transistor coupled between a data line and the second switch transistor, and the second switch transistor having a first terminal connected to the first terminal of the drive transistor and a second terminal connected to a gate terminal of the drive transistor, such that, during a compensation cycle of a programming cycle while the second switch transistor is selected via a select line and while a high voltage, which exceeds a programming voltage to be applied to the drive transistor through the first switch transistor, is applied to the data line, the second switch transistor is allowed to charge or discharge a node of the pixel circuit, through the drive transistor, via the second switch transistor, until the drive transistor turns off, thereby establishing the threshold voltage of the drive transistor between the gate terminal and the first terminal of the drive transistor;

during an operating cycle of the programming cycle following the compensation cycle, via an intermediate voltage on the select line, turning off the second switch transistor and turning on the first switch transistor for applying the programming voltage from the data line to the drive transistor through the first switch transistor, thereby establishing a fixed voltage applied to the drive transistor according to both the threshold voltage and the applied programming voltage, wherein the programming voltage is lower than the high voltage; and a controllable power supply connected to the light-emitting device for supplying the drive transistor with a voltage that is adjusted to a compensation voltage sufficient to turn off the light emitting device, during the compensation cycle.

9. The display system of claim 8, wherein the node that is charged or discharged, via the second switch transistor, is directly connected to the gate terminal of the drive transistor.

10. The display system of claim 8 in which the controllable voltage source maintains a substantially constant pixel current as the threshold voltage of the drive transistor changes with the aging of the drive transistor.

11. The display system of claim 8 in which the light-emitting device includes an OLED supplied with the stable pixel current from the drive transistor, and the stable pixel current maintains a substantially constant brightness of the light emitted by the OLED.

12. The display system of claim 8 in which the light-emitting device includes an OLED having a voltage $V_{OLED}$ that increases as the OLED ages.

13. The display system of claim 8, wherein the pixel circuit is configured to receive, via the first switch transistor, a reference voltage applied to a terminal of a storage capacitor, the storage capacitor being coupled to the gate terminal of the drive transistor such that the storage capacitor is charged according to the threshold voltage of the drive transistor during the compensation cycle.

14. The display system of claim 8, wherein the pixel circuit further includes:

a storage capacitor coupled to the gate terminal of the drive transistor, the storage capacitor adapted to apply a voltage to the drive transistor during a driving cycle of the pixel circuit during which the pixel circuit is operated to drive the light emitting device to emit light according to programming information, wherein the first switch transistor is adapted to selectively couple the data line to the storage capacitor during the compensation cycle and during the programming cycle of the pixel circuit during which the pixel circuit receives the programming voltage according to the programming information.

15. The display system of claim 8 wherein the light-emitting device is an organic light emitting diode and the drive transistor is an n-type or p-type thin film transistor.

* * * * *